US007199771B2

(12) United States Patent
Yamazaki et al.

(10) Patent No.: US 7,199,771 B2
(45) Date of Patent: Apr. 3, 2007

(54) LIGHT EMITTING DEVICE AND ELECTRONIC APPARATUS USING THE SAME

(75) Inventors: Shunpei Yamazaki, Tokyo (JP); Jun Koyama, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 486 days.

(21) Appl. No.: 10/256,163

(22) Filed: Sep. 27, 2002

(65) Prior Publication Data

US 2003/0063053 A1 Apr. 3, 2003

(30) Foreign Application Priority Data

Sep. 28, 2001 (JP) ..... 2001-299453

(51) Int. Cl.
*G09G 3/36* (2006.01)

(52) U.S. Cl. ..... 345/84; 345/89

(58) Field of Classification Search ..... 345/76–82, 345/83–100, 204, 211, 214; 315/169.1, 169.3
See application file for complete search history.

(56) References Cited

U.S. PATENT DOCUMENTS

| | | | |
|---|---|---|---|
| 5,247,190 | A | 9/1993 | Friend et al. |
| 5,399,502 | A | 3/1995 | Friend et al. |
| 5,708,451 | A | 1/1998 | Baldi |
| 5,778,146 | A | 7/1998 | Kawasaki et al. |

(Continued)

FOREIGN PATENT DOCUMENTS

| | | | |
|---|---|---|---|
| EP | 0 923 067 | A1 | 6/1999 |
| EP | 1 071 070 | A2 | 1/2001 |
| GB | 2 106 299 | A | 4/1983 |
| JP | 04-009996 | | 1/1992 |

(Continued)

OTHER PUBLICATIONS

Tsutsui et al., "Electrominescence in Organic Thin Films", Photochemical Processes in Organized Molecular Systems, 1991, pp. 437–450 (Elsevier Science Publishers, Tokyo, 1991).

M. A. Baldo et al., "Highly Efficient Phosphorescent Emission from Organic Electroluminescent Devices", Nature vol. 395, Sep. 10, 1998, pp. 151–154.

(Continued)

*Primary Examiner*—Bipin Shalwala
*Assistant Examiner*—Nitin Patel
(74) *Attorney, Agent, or Firm*—Nixon Peabody LLP; Jeffrey L. Costellia

(57) ABSTRACT

Providing a light emitting device capable of suppressing the variations of luminance of OLEDs associated with the deterioration of an organic light emitting material, and achieving a consistent luminance. An input image signal is constantly or periodically sampled to sense a light emission period or displayed gradation level of each of light emitting elements of pixels and then, a pixel suffering the greatest deterioration and decreased luminance is predicted from the accumulations of the sensed values. A current supply to the target pixel is corrected for achieving a desired luminance. The other pixels than the target pixel are supplied with an excessive current and hence, the individual gradation levels of the pixels are lowered by correcting the image signal for driving the pixel with the deteriorated light emitting element on as-needed basis, the correction of the image signal made by comparing the accumulation of the sensed values of each of the other pixels with a previously stored data on a time-varying luminance characteristic of the light emitting element.

35 Claims, 23 Drawing Sheets

U.S. PATENT DOCUMENTS

| | | | | | |
|---|---|---|---|---|---|
| 6,011,529 | A | * | 1/2000 | Ikeda | 345/77 |
| 6,127,991 | A | | 10/2000 | Uehara et al. | |
| 6,191,534 | B1 | | 2/2001 | Schuler et al. | |
| 6,219,017 | B1 | | 4/2001 | Shimada et al. | |
| 6,249,268 | B1 | | 6/2001 | Tachibana et al. | |
| 6,337,542 | B1 | | 1/2002 | Hanaki et al. | |
| 6,414,661 | B1 | | 7/2002 | Shen et al. | |
| 6,456,337 | B1 | | 9/2002 | Kobayashi et al. | |
| 6,473,065 | B1 | | 10/2002 | Fan | |
| 6,501,230 | B1 | | 12/2002 | Feldman | |
| 6,518,962 | B2 | * | 2/2003 | Kimura et al. | 345/211 |
| 6,525,683 | B1 | | 2/2003 | Gu | |
| 6,542,260 | B1 | | 4/2003 | Gann et al. | |
| 6,618,084 | B1 | | 9/2003 | Rambaldi et al. | |
| 6,628,848 | B1 | | 9/2003 | Nakamura | |
| 6,771,281 | B2 | * | 8/2004 | Takagi | 345/690 |
| 6,812,651 | B2 | * | 11/2004 | Iwata et al. | 315/169.3 |
| 6,897,837 | B1 | | 5/2005 | Sakumoto et al. | |
| 2001/0020922 | A1 | | 9/2001 | Yamazaki et al. | |
| 2001/0045929 | A1 | | 11/2001 | Prache et al. | |
| 2002/0030449 | A1 | * | 3/2002 | Okazaki et al. | 315/169.1 |
| 2002/0033783 | A1 | | 3/2002 | Koyama | |
| 2002/0047550 | A1 | | 4/2002 | Tanada | |
| 2002/0089291 | A1 | * | 7/2002 | Kaneko et al. | 315/169.3 |
| 2002/0101395 | A1 | | 8/2002 | Inukai | |
| 2002/0105279 | A1 | | 8/2002 | Kimura | |
| 2002/0180721 | A1 | | 12/2002 | Kimura et al. | |
| 2003/0063081 | A1 | | 4/2003 | Kimura et al. | |
| 2003/0071804 | A1 | | 4/2003 | Yamazaki et al. | |
| 2004/0008166 | A1 | * | 1/2004 | Kimura | 345/76 |

FOREIGN PATENT DOCUMENTS

| | | | |
|---|---|---|---|
| JP | 05-273939 | | 10/1993 |
| JP | 07-036410 | | 2/1995 |
| JP | 10-92576 | | 4/1998 |
| JP | 10-112391 | A | 4/1998 |
| JP | 10-254410 | | 9/1998 |
| JP | 11-015437 | | 1/1999 |
| JP | 11-305722 | | 11/1999 |
| JP | 2001-056670 | | 2/2001 |
| JP | 2001-092411 | | 4/2001 |
| WO | WO 90/13148 | | 11/1990 |
| WO | WO 01/54107 | A1 | 7/2001 |
| WO | WO 01/63587 | A2 | 8/2001 |

OTHER PUBLICATIONS

M. A. Baldo et al., Very High–Efficiency Green Organic Light–Emitting Devices Based on Electrophosphorescence:, Applied Physics Letters vol. 75, No. 1, Jul. 5, 1999, pp. 4–6.

Tsutsui et al., "High Quantum Efficiency in Organic Light–Emitting Devices with Iridium–Complex as Triplet Emissive Center", Japanese Journal of Applied Physics vol. 38, Part 12B, Dec. 15, 1999, pp. L1502–L1504.

H. Shenk et al., "Polymers for Light–Emitting Diodes", Euro Display Proceedings 1999, pp. 33–37.

Tsutsui et al., "High Quantum Efficiency in Organic Light–Emitting Devices with Iridium–Complex as Triplet Emissive Center", Japanese Journal of Applied Physics, vol. 38, Part 2, No. 12B, Dec. 15, 1999, pp. L1502–L1504.

H. Shenk et al., "Polymers for Light–Emitting Diodes", Euro Display 1999, Proceedings of the 19$^{th}$ IDRC, pp. 33–37.

Shimoda et al., "*Current Status and Future of Light–Emitting Polymer Display Driven by Poly–Si TFT*"; Society for Information Display International Symposium Digest of Technical Papers –vol. XXX; May 18–20, 1999, pp. 372–375.

Australian Patent Office Search Report for SG 200205775–0 filed Sep. 24, 2002 for "A Light Emitting Device and Electronic Apparatus Using the Same", Oct. 28, 2004.

Office Action (Application No. 09/948091; US5200 (U04969), Dated May 3, 2005.

Australian Patent Office Search Report (Application No. 200205774.3; SG5990) Dated Jul. 12, 2005.

Shimoda et al.; "*High Resolution Light Emitting Polymer Display Driven by Low Temperature Polysilicon Thin Film Transistor with Integrated Driver*"; Asia Display Jan. 1, 1998; pp. 217–220;.

Han et al.; "*Green OLED with low temperature poly Si TFT*"; EuroDisplay '99: The 19$^{th}$ International Display Research Conference –Late news papers; Sep. 1, 1999, pp. 27–30.

Shimoda et al.; "*Current Status and Future of Light–Emitting Polymer*"; Society for Information Display International Symposium Digest of Technical Papers –vol. XXX; Jan. 1, 1999; pp. 372–375.

Australian Patent Office Search Report for Application No. SG–200205774–3; Oct. 28, 2004.

Australian Patent Office Search Report for SG 200205775–0 filed Sep. 24, 2002 for "A Light Emitting Device and Electronic Apparatus Using the Same".

* cited by examiner

LIGHT EMITTING DEVICE AND ELECTRONIC APPARATUS USING THE SAME

BACKGROUND OF THE INVENTION

1. Field of the Invention

The present invention relates to a light emitting panel in which a light emitting element formed on a substrate is enclosed between the substrate and a cover member. Also, the present invention relates to a light emitting module in which an IC or the like is mounted on the light emitting panel. Note that, in this specification, the light emitting panel and the light emitting module are generically called light emitting devices. The present invention further relates to electronic apparatuses utilizing the light emitting devices.

2. Description of the Related Art

A light emitting element emits light by itself, and thus, has high visibility. The light emitting element does not need a backlight necessary for a liquid crystal display device (LCD), which is suitable for a reduction of a light emitting device in thickness. Also, the light emitting element has no limitation on a viewing angle. Therefore, the light emitting device using the light emitting element has recently been attracting attention as a display device that substitutes for a CRT or the LCD.

Incidentally, the light emitting element means an element of which a luminance is controlled by electric current or voltage in this specification. The light emitting element includes an OLED (organic light emitting diode), an MIM type electron source element (electron emitting elements) used to a FED (field emission display) and the like.

The OLED includes a layer containing an organic compound in which luminescence generated by application of an electric field (electroluminescence) is obtained (organic light emitting material) (hereinafter, referred to as organic light emitting layer), an anode layer and a cathode layer. A light emission in returning to a base state from a singlet excitation state (fluorescence) and a light emission in returning to a base state from a triplet excitation state (phosphorescence) exist as the luminescence in the organic compound. The light emitting device of the present invention may use one or both of the above-described light emissions.

Note that, in this specification, all the layers provided between an anode and a cathode of the OLED are defined as organic light emitting layers. The organic light emitting layers specifically include a light emitting layer, a hole injecting layer, an electron injecting layer, a hole transporting layer, an electron transporting layer and the like. These layers may have an inorganic compound therein. The OLED basically has a structure in which an anode, a light emitting layer, a cathode are laminated in order. Besides this structure, the OLED may take a structure in which an anode, a hole injecting layer, a light emitting layer, a cathode are laminated in order or a structure in which an anode, a hole injecting layer, a light emitting layer, an electron transporting layer, a cathode are laminated in order.

On the other hand, the decreased luminance of OLED resulting from the deterioration of the organic light emitting material poses a serious problem on the practical use of the light emitting devices.

FIG. 21A graphically illustrates a time-varying luminance of the light emitting element when a constant current is applied between the two electrodes thereof. As shown in FIG. 21A, the luminance of the light emitting element decreases despite the application of the constant current because the organic light emitting material is deteriorated with time.

FIG. 21B graphically illustrates a time-varying luminance of the light emitting element when a constant voltage is applied between the two electrodes thereof. As shown in FIG. 21B, the luminance of the light emitting element decreases with time despite the application of the constant voltage. This is partly because, as shown in FIG. 21A, the deterioration of the organic light emitting material entails the decrease of the luminance at the constant current and partly because the current flow through the light emitting element caused by the constant voltage is decreased with time, as shown in FIG. 21C.

The decreased luminance of the light emitting element with time can be compensated by increasing the current supply to the light emitting element or increasing the voltage applied thereto. In most cases, however, an image to be displayed includes gradation levels varying from pixel to pixel so that the individual light emitting elements of the pixels are deteriorated differently, resulting in the variations of luminance. Since it is impracticable to provide each of the pixels with a power source for supplying voltage or current thereto, a common power source for supplying the voltage or current to all the pixels or a group of some pixels. Therefore, if the voltage or current supply from the common power source is simply increased to compensate for the decrease in the luminance of some light emitting elements due to deterioration, all the pixels supplied with the increased voltage or current are uniformly increased in luminance. Hence, the luminance variations among the individual light emitting elements of the pixels are not eliminated.

SUMMARY OF THE INVENTION

In view of the foregoing, it is an object of the invention to provide a light emitting device capable of suppressing the luminance variations of the OLEDs associated with the deterioration of the organic light emitting material and achieving a consistent luminance.

The light emitting device according to the invention is adapted to sample a supplied image signal constantly or periodically for sensing the light emission period or displayed gradation level of each of the light emitting elements of the pixels, so as to predict a pixel most deteriorated and decreased in luminance from the accumulations of the sensed values or the sums of the sensed values. Then, the accumulation of the sensed values of the target pixel is compared with the previously stored data on the time-varying luminance characteristic of the light emitting element for correcting the current supply to the target pixel, so that a desired luminance can be achieved. At this time, an excessive current is supplied to the other pixels that share the common current source with the most deteriorated pixel. It is thus suggested that the other pixels have greater luminances than the most deteriorated pixel, displaying too high gradation levels. The other pixels are individually lowered in the gradation level by correcting the image signal for driving the pixel having the most deteriorated light emitting element, the correction of the image signal done by comparing the accumulation of the sensed values of each of the pixels with the previously stored data on the time-varying luminance characteristic of the light emitting element.

It is noted that the image signal herein is defined to mean a digital signal containing image information.

Despite the varied degrees of deterioration of the light emitting elements of the pixels, the above arrangement eliminates the luminance variations for assuring the consistent luminance of the screen and also suppresses the decrease of luminance due to deterioration.

It is noted that the value of the current supply from the current source need not necessarily be corrected based on the most deteriorated pixel but the correction may be made based on a pixel least deteriorated. In this case, a pixel having the greatest luminance due to the least deterioration is predicted from the accumulations of the sensed values of the individual pixels. Then the accumulation of the sensed values of the target pixel is compared with the previously stored data on the time-varying luminance characteristic of the light emitting element for correcting the current supply to the target pixel, so that a desired luminance can be achieved. At this time, an insufficient current is supplied to the other pixels that share the common current source with the pixel least deteriorated. It is thus suggested that the other pixels have lower luminances than the least deteriorated pixel, displaying too low gradation levels. The other pixels are individually increased in the gradation level by correcting the image signal for driving the pixel having the least deteriorated light emitting element, the correction of the image signal done by comparing the accumulation of the sensed values of each of the pixels with the previously stored data on the time-varying luminance characteristic of the light emitting element.

It is noted that a designer can arbitrarily define the reference pixel. As to those pixels more deteriorated than the reference pixel, the image signal may be so corrected as to increase the gradation levels of the pixels. As to those pixels less deteriorated than the reference pixel, the image signal may be so corrected as to lower the gradation levels of the pixels.

DESCRIPTION OF THE PREFERRED EMBODIMENTS

Figure 1:
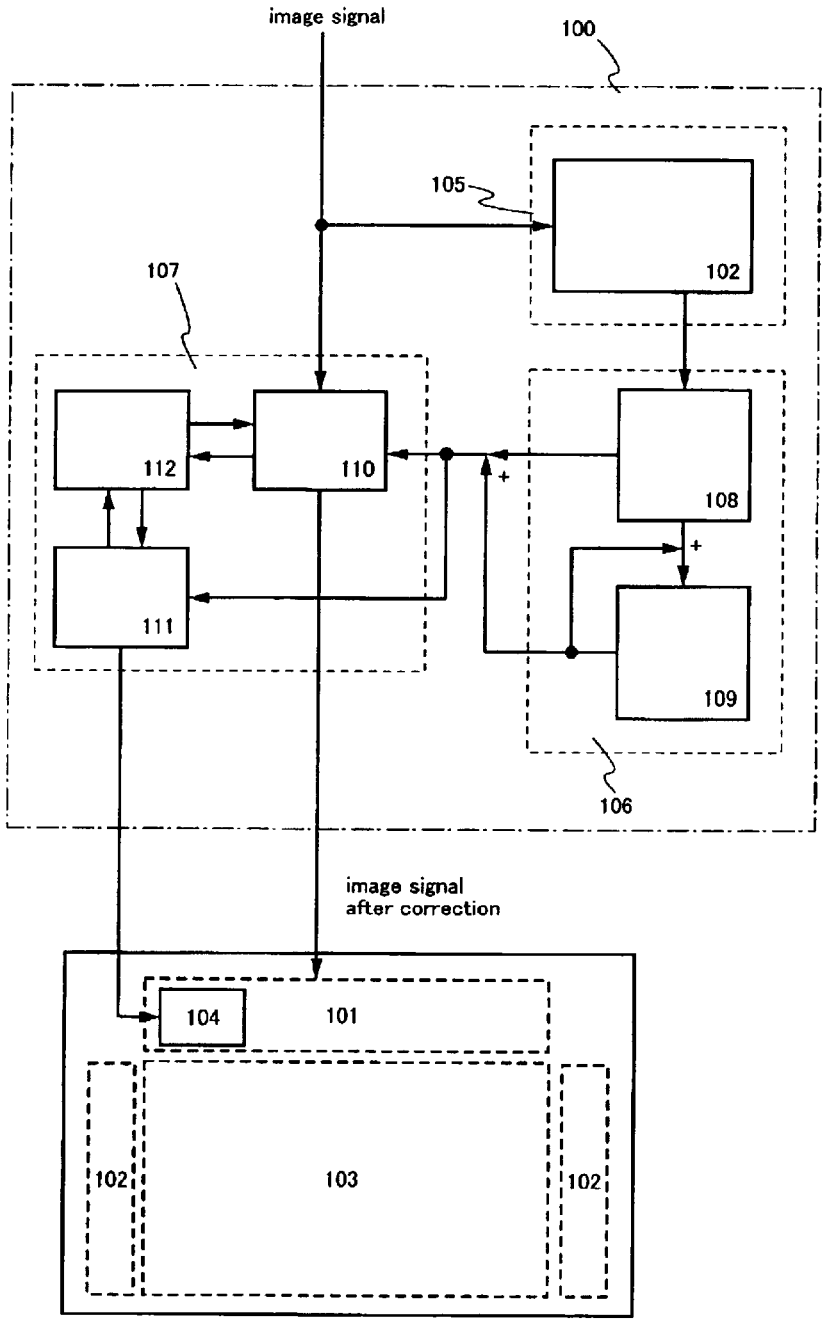
FIG. 1 is a block diagram showing a light emitting device according to the invention.

An arrangement of a light emitting device according to the invention will hereinbelow be described. FIG. 1 is a block diagram showing a light emitting device according to the invention, which includes a deterioration correction unit 100, a signal line drive circuit 101, a scanning line drive circuit 102, a pixel portion 103, and a current source 104. In this embodiment, the deterioration correction unit 100 is formed on a different substrate from a substrate where the current source 104, signal line drive circuit 101, scanning line drive circuit 102 and pixel portion 103 are formed. If possible, however, all these elements may be formed on a same substrate. Although the current source 104 is included in the signal line drive circuit 101 according to this embodiment, the invention is not limited to this arrangement. The location of the current source 104 varies depending upon the pixel configuration but it is critical to assure that the current source is connected in a manner to permit the control of the magnitude of a current supplied to a light emitting element.

The pixel portion 103 includes a plurality of pixels each having a light emitting element. The deterioration correction unit 100 processes an image signal supplied to the light emitting device to correct a current supplied from the current source 104 to the individual light emitting elements of the pixels and to correct the image signal supplied to the signal line drive circuit in order that the individual light emitting elements of the pixels may present a consistent luminance. The scanning line drive circuit 102 sequentially selects the pixels provided at the pixel portion 103 whereas the signal line drive circuit 101 responds to a corrected image signal inputted thereto to supply a current or voltage to a pixel selected by the scanning line drive circuit 102.

The deterioration correction unit 100 comprises a counter portion 105, a memory circuit portion 106 and a correction portion 107. The counter portion 105 includes a counter 102. The memory circuit portion 106 includes a volatile memory 108 and a non-volatile memory 109 whereas the correction portion 107 includes an image signal correction circuit 110, a current correction circuit 111 and a correction data storage circuit 112.

Next, description is made on the operations of the deterioration correction unit 100. First, data on a time-varying luminance characteristic of the light emitting element employed in the light emitting device are previously stored in the correction data storage circuit 112. The data, which will be described hereinlater, are mainly used for the correction of the current supplied from the current source 104 to each of the pixels as well as for the correction of the image signal, the corrections performed according to the degree of deterioration of the respective light emitting elements of the pixels.

Subsequently, image signals supplied to the light emitting device are constantly or periodically (at time intervals of 1 second, for instance) sampled while the counter 102 counts respective light emission periods or gradation levels of the individual light emitting elements of the pixels based on the information of the image signals. The light emission periods or gradation levels of the individual pixels thus counted are used as data, which are sequentially stored in the memory circuit portion. It is noted here that since the light emission periods or gradation levels need be stored in a cumulative manner, the memory circuit may preferably comprise a non-volatile memory. However, in general, the non-volatile memory is limited in the number of writings and hence, an arrangement may be made such that the volatile memory 108 is operated to store the data during the operation of the light emitting device while the data are written to the non-volatile memory 109 at regular time intervals (at time intervals of 1 hour or at the shutdown of the power source, for instance).

Embodiments of a usable volatile memory include, but are not limited to, static memories (SRAM), dynamic memories (DRAM), ferroelectric memories (FRAM) and the like. That is, the volatile memory may comprise any type of memory. Likewise, the non-volatile memory may also comprise any of the memories generally used in the art, such as a flash memory. It is noted, however, that in a case where DRAM is employed as the volatile memory, a need exists for adding a periodical refreshing function.

The cumulative data on the light emission periods or gradation levels stored in the volatile memory 108 or the non-volatile memory 109 are inputted to the image signal correction circuit 110 and the current correction circuit 111.

The current correction circuit 111 grasps a degree of deterioration of each of the pixels by comparing the data on the time-varying luminance characteristic previously stored in the correction data storage circuit 112 with the cumulative data on the light emission periods or gradation levels of each of the pixels, which are stored in the memory circuit portion 106. The current correction circuit thus detects a particular pixel suffering the greatest deterioration, and then corrects the value of the current supply from the current source 104 to the pixel portion 103 based on the degree of deterioration of the particular pixel. Specifically, the current value is increased so as to permit the particular pixel to display a desired gradation level.

Since the value of the current supply to the pixel portion 103 is corrected based on the particular pixel, the light emitting elements of the other pixels, which are not so much deteriorated as the particular pixel, are supplied with an excessive current, thus failing to accomplish a desired gradation level. Therefore, the image signal correction circuit 110 corrects the image signal for determining the gradation levels of the other pixels. In addition to the cumulative data on the light emission periods or gradation levels, the image signals are inputted to the image signal correction circuit 110. The image signal correction circuit 110 grasps a degree of deterioration of each of the pixels by comparing the data on the time-varying luminance characteristic previously stored in the correction data storage circuit 112 with the cumulative data on the light emission periods or gradation levels of each pixel. Thus, the correction circuit detects a particular pixel suffering the greatest deterioration and corrects the input image signal based on the degree of deterioration of the particular pixel. Specifically, the image signal is so corrected as to obtain a desired gradation level. The corrected image signal is inputted to the signal line drive circuit 101.

It is noted that the particular pixel may not be the one that suffers the greatest deterioration but may be a pixel with the least deterioration or a pixel arbitrarily determined by a designer. Whatever pixel may be selected, the image signal is corrected in the following manner. That is, a value of the current supplied from the current source 104 to the pixel portion 103 is decided based on the selected pixel. As to a pixel more deteriorated than the selected pixel, the image signal is so corrected as to increase the gradation level. As to a pixel less deteriorated than the selected pixel, on the other hand, the image signal is so corrected as to decrease the gradation level.

Figure 2:
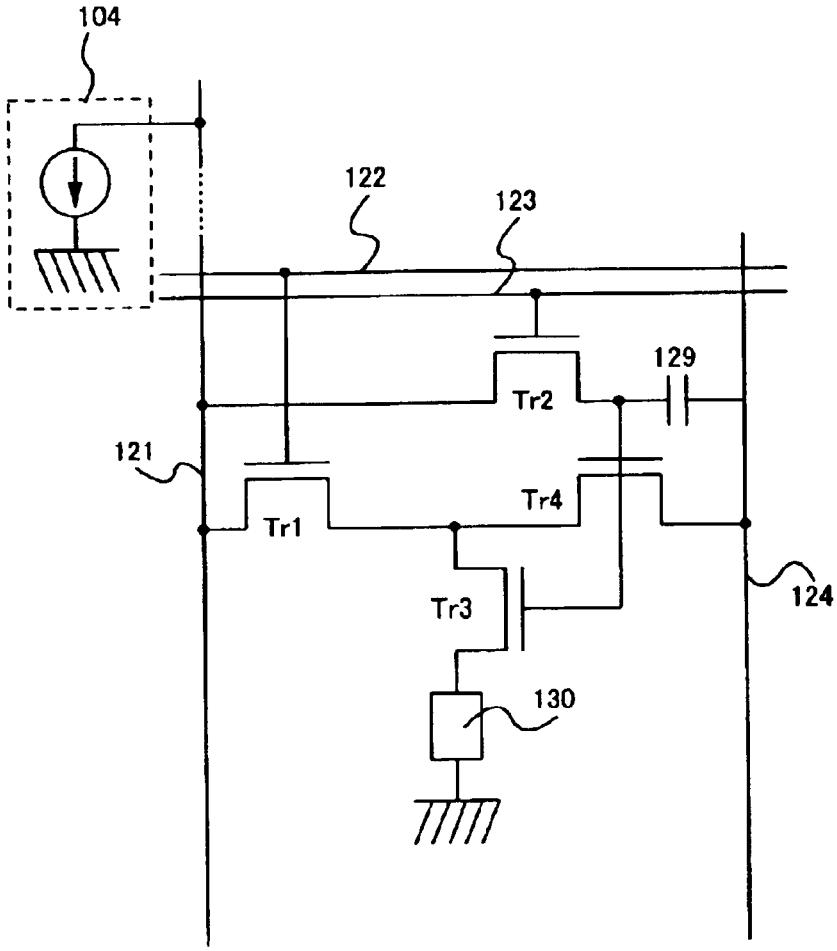
FIG. 2 is a diagram showing a pixel circuitry of the light emitting device according to the invention.

FIG. 2 shows an example of the pixel included in the light emitting device according to the invention. The pixel of FIG. 2 includes a signal line 121, a first and second scanning line 122 and 123, a power line 124, transistors Tr1, Tr2, Tr3 and Tr4, a capacitance 129 and a light emitting element 130.

A gate of the transistor Tr1 is connected to the first scanning line 122. Tr1 has its source connected to the signal line 121 and its drain connected to a source of the transistor Tr3 and a drain of the transistor Tr4. A gate of the transistor Tr2 is connected to the second scanning line 123. Tr2 has its source connected to a gate of the transistor Tr3 and a gate of the transistor Tr4 and its drain connected to the signal line 121. The transistor Tr3 has its drain connected to a pixel electrode of the light emitting element 130. The transistor Tr4 has its source connected to the power line 124. The capacitance 129 is connected between the gate and source of the transistor Tr4 for retaining a voltage across the gate and source of the transistor Tr4. Predetermined potentials are applied to the power line 124 and a cathode of the light emitting element 130 such that the power line and the cathode have a potential difference therebetween.

When the transistors Tr1 and Tr2 are turned ON by a voltage applied to the first and second scanning lines 122 and 123, a drain current of the transistor Tr4 is controlled by the current source 104 included in the signal line drive circuit 101. It is noted here that the transistor Tr4 operates in a saturation region because the transistor has its gate and drain interconnected. A drain current of the transistor Tr4 is expressed by the following expression 1:

$$I=\mu C_O W/L(V_{GS}-V_{TH})^2/2 \qquad \text{expression 1}$$

where $V_{GS}$ denotes a gate voltage; μ denotes a mobility; $C_O$ denotes a gate capacitance per unit area; W/L denotes a ratio between a channel width W of a channel forming region and a channel length L thereof; $V_{TH}$ denotes a threshold value; and I denotes a drain current.

In Expression 1, all the parameters μ, $C_O$, W/L, and $V_{TH}$ represent fixed values determined by the individual transistors. It is understood from Expression 1 that the drain current of the transistor Tr4 varies depending upon the gate voltage $V_{GS}$. Thus, according to Expression 1, a gate voltage $V_{GS}$ corresponding to a drain current occurs in the transistor Tr4. The gate voltage $V_{GS}$ is retained by the capacitance 129.

When the transistors Tr1 and Tr2 are turned OFF by the voltage applied to the first and second scanning lines 122 and 123, a part of the charge accumulated on the capacitance 129 is moved to the gate of the transistor Tr3, thereby automatically turning ON the transistor Tr4. Accordingly, a current of a magnitude commensurate with the charge retained by the capacitance flows to the light emitting element 130 which, in turn, emits light. Thus, the magnitude of the current through the light emitting element 130 can be determined by the current supplied from the current source 104.

According to the light emitting device of the invention, the magnitude of the current supplied from the current source 104 to the pixel is corrected by means of the current correction circuit 111. In a case where the image signal is digital, the current inputted to the pixel as the image signal has only two values and hence, the image signal correction circuit 110 so corrects the image signal as to change the length of the light emission period of the light emitting element 130 for the purpose of controlling the gradation level of the pixel. In a case where the image signal is analogous, the gradation level of the pixel is controlled by means of the image signal correction circuit 110 which so corrects the image signal as to change the magnitude of the current supplied to the light emitting element.

Figure 3A:
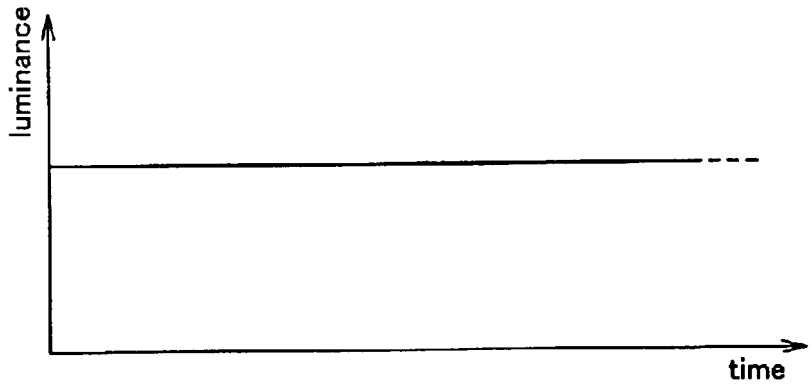
FIGS. 3A and 3B are graphs illustrating a relation between the current through a light emitting element and the time-varying luminance thereof according to the light emitting device of the invention.
Figure 3B:
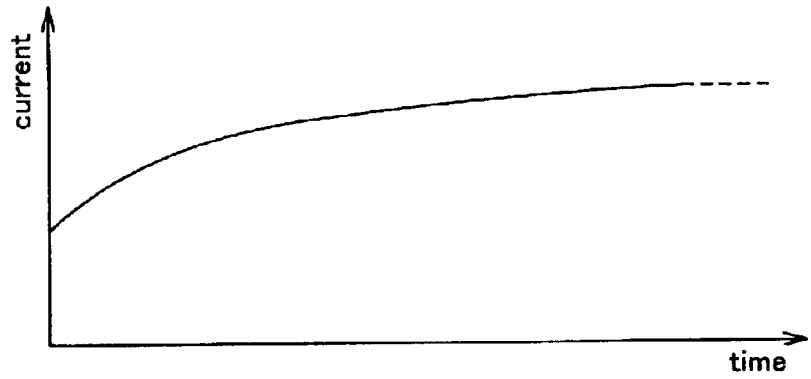

FIG. 3A shows a time-varying luminance of the light emitting element included in the light emitting device of the invention. By virtue of the above correction, the luminance of the light emitting element is maintained at a constant level. FIG. 3B shows a time-varying current through the light emitting element included in the light emitting device of the invention. The current through the light emitting element is increased for compensation of the decrease in luminance associated with deterioration.

In FIG. 3, the correction is performed to maintain the luminance of the light emitting element at a constant level at all times. However, in a case where the correction is performed at given time intervals, for example, the luminance is not always maintained at a constant level because the correction is performed at a time when the luminance of the light emitting element is lowered to some degree.

Figure 4:
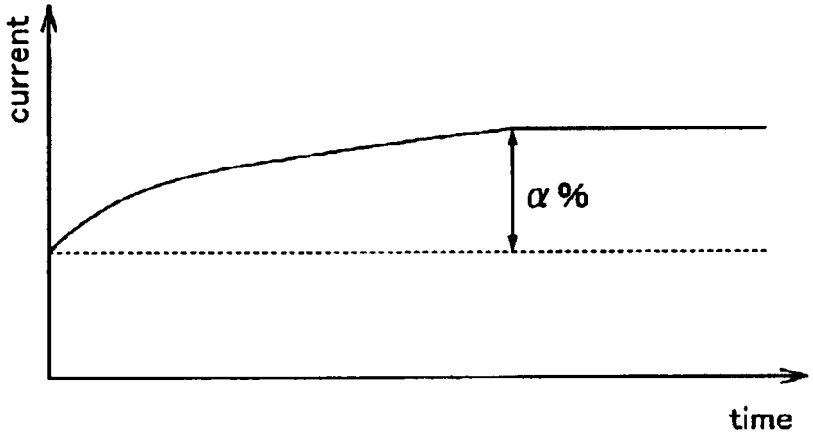
FIG. 4 is a graph representing the time-varying amount of current through the light emitting element of the light emitting device according to the invention.

With advance of the deterioration of the light emitting element, the current through the light emitting element is infinitely increased. An excessively great current through the light emitting element speeds up the deterioration thereof, promoting the occurrence of a non-emitting spot (dark spot). Therefore, as shown in FIG. 4, the invention may be arranged such that the increase of the current by the correction is suspended when the current through the light emitting element is increased by a given value ($\alpha$%) from an initial value and then, the current supply from the current source to the light emitting element is maintained at a constant level.

It is noted that the pixel of the light emitting device of the invention is not limited to the configuration shown in FIG. 2. The pixel of the invention may have any configuration that permits the current through the light emitting element to be controlled by means of the current source.

According to the light emitting device of the invention, when the power is shut down, the cumulative data representing the light emission periods or gradation levels of the individual pixels and stored in the volatile memory 108 may be added to the cumulative data on the light emission periods or gradation levels, which are stored in the non-volatile memory 109, and the resultant data may be stored in the non-volatile memory. This permits the collection of the cumulative data on the light emission periods or gradation levels of the light emitting elements to be continued after the subsequent power-up.

In the aforementioned manner, the light emission periods or gradation levels of the light emitting elements are constantly or periodically sensed while the cumulative data on the light emission periods or gradation levels are stored for comparison with the previously stored data on the time-varying luminance characteristic of the light emitting elements, so that the image signal may be corrected on an as-needed basis. This permits the image signal to be corrected such that a deteriorated light emitting element can achieve an equivalent luminance to that of an undeteriorated light emitting element. As a result, the variations in luminance are prevented and a consistent screen display is assured.

Although the light emission periods or gradation levels of the individual light emitting elements are sensed according to the embodiment of the invention, an arrangement may be made such that only the presence or absence of light emission from the individual light emitting elements is determined at some point of time. The detection of the presence of light emission from the individual light emitting elements is repeated in cycles so that the degree of deterioration of each light emitting element can be estimated from a ratio of the number of light emissions therefrom versus the total count of detections.

According to FIG. 1, the corrected image signal is directly inputted to the signal line drive circuit. In a case where the signal line drive circuit is adapted for an analog image signal, a D/A converter circuit may be provided such that the digital image signal is converted to an analog signal before inputted.

Although the foregoing description is made by way of an example where OLED is employed as the light emitting element, the light emitting device of the invention does not exclusively employ OLED but may employ any other light emitting elements such as PDP, FED and the like.

EMBODIMENT

Embodiments of the invention will be described as below.

Embodiment 1

In this embodiment, description is made on a method for correcting the image signal which is adopted by the correction portion of the light emitting device according to the invention.

In one approach to complement the decreased luminance of the deteriorated light emitting element on the basis of a signal, a given correction value is added to an input image signal to convert the input signal to a signal practically representing a gradation level increased by several steps thereby achieving a luminance equivalent to that prior to the deterioration. The simplest way to implement this approach in circuit design is to provide a circuit in advance which is capable of processing data on an extra gradation level.

Specifically, in the case of a light emitting device adapted for 6-bit digital gradations (64 gradation levels) and including the deterioration correction function of the invention, for example, the device is so designed and fabricated as to have an additional capability of processing an extra 1 bit data for performing the correction and to practically process 7-bit digital gradations (128 gradation levels). Then, the device operates on the lower order 6-bit data in normal operation.

When the deterioration of the light emitting element occurs, the correction value is added to the normal image signal and the aforesaid extra 1-bit is used for processing the signal of the added value. In this case, MSB (most significant bit) is used for the signal correction alone so that practically displayed gradation comprises 6 bits.

Embodiment 2

In this embodiment, description is made on a method for correcting the image signal in a different way from that of Embodiment 1.

Figure 5A:
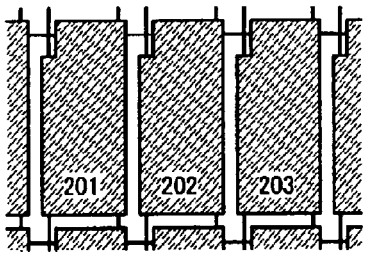
FIGS. 5A–5C are diagrams illustrating a correction method based on an adding operation.

FIG. 5A is an enlarged view showing the pixel portion 103 of FIG. 1. Here, three pixels 201 to 203 are discussed. It is assumed that the pixel 201 suffers the least deterioration, the pixel 202 suffering a greater deterioration than the pixel 201, the pixel 203 suffering the greatest deterioration.

Figure 5B:
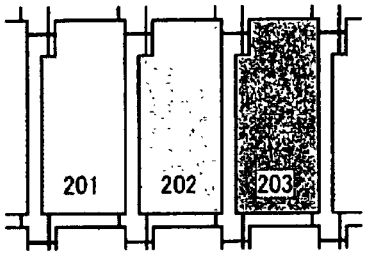

The greater the deterioration of the pixel, the greater the decrease of luminance of the pixel. Without the correction of luminance, the pixels, which are displaying a certain half tone, will encounter luminance variations as shown in FIG. 5B. That is, the pixel 202 presents a lower luminance than the pixel 201 whereas the pixel 203 presents a much lower luminance than the pixel 201.

Next, actual correction operations are described. Measurement is previously taken to obtain a relation between the cumulative data on the light emission periods or gradation levels of the light emitting element and the decrease in the luminance thereof due to deterioration. It is noted that the cumulative data on the light emission periods or gradation levels and the decrease in the luminance of the light emitting element due to deterioration do not always present a simple relation. The degrees of deterioration of the light emitting element versus the cumulative data on the light emission periods or gradation levels are stored in the correction data storage circuit 112 in advance.

The current correction circuit 111 determines a correction value for the current supply from the current source 104 based on the data stored in the correction data storage circuit 112. The correction value for the current is determined based on the cumulative data on the light emission periods or gradation levels of a reference pixel. If the pixel 203 with the greatest deterioration is used as reference, for example, the pixel 203 is allowed to attain a desired gradation level but the pixels 201 and 202 are applied with an excessive current so that an image signal therefor requires correction. Thus, the image signal correction circuit 110 so corrects the input image signal as to achieve the desired gradation levels based on the degree of deterioration of the particular pixel having the greatest deterioration. Specifically, the cumulative data on the light emission periods or gradation levels are compared between the reference pixel and another pixel; a difference between the gradation levels of these pixels is calculated; and the image signal is so corrected as to compensate for the gradation level difference.

Referring to FIG. 1, the image signal is inputted to the image signal correction circuit 110, which reads out the cumulative data on the light emission periods or gradation levels of each of the pixels, the cumulative data stored in the memory circuit portion 106. The image signal correction circuit decides a correction value for each image signal by comparing the read cumulative data on the light emission periods or gradation levels of each of the pixels with the degrees of deterioration of the light emitting element associated with the cumulative data on the light emission periods or gradation levels thereof, the degrees of deterioration stored in the correction data storage circuit 112.

In a case where the correction is performed using the pixel 203 as reference, is for example, the pixels 201 and 202 differ from the pixel 203 in the degree of deterioration, thus requiring the correction of the gradation levels by way of the image signal. It is expected from the cumulative data on the light emission periods or gradation levels of these pixels that the pixel 201 has a greater difference from the pixel 203 in the degree of deterioration than the pixel 202 does. Hence, the gradation level of the pixel 201 is corrected by a greater number of steps as compared with the correction for the pixel 202.

Figure 5C:
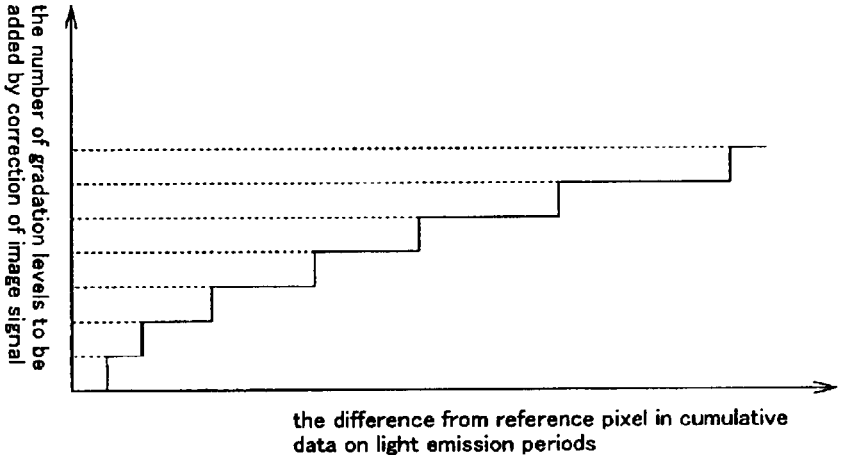

FIG. 5C graphically shows a relation between the difference from the reference pixel in the cumulative data on the light emission periods or gradation levels and the number of gradation levels corrected by way of the image signal. It is noted that since the cumulative data on the light emission periods or gradation levels and the decrease in the luminance of the light emitting element due to deterioration do not always have a simple relation, the number of gradation levels to be added by the correction of the image signal does not always present a simple relation against the cumulative data on the light emission periods or gradation levels. As described above, the correction based on the adding operation assures the consistent luminance of screen.

Figure 20:
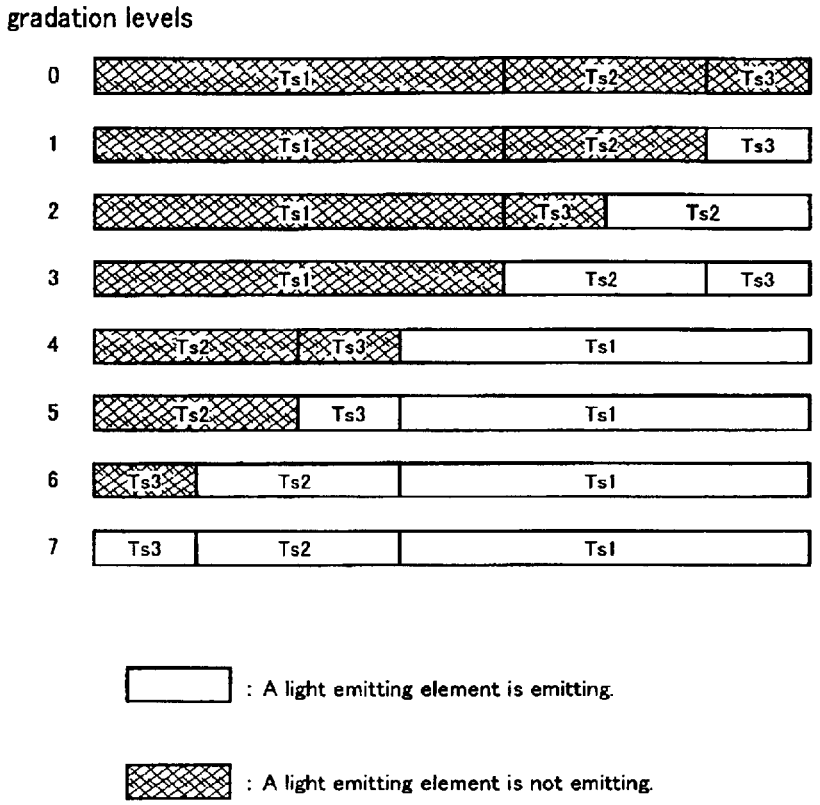
FIG. 20 is a graph representing a relation between the gradation level and the light emission period.
Figure 21A:
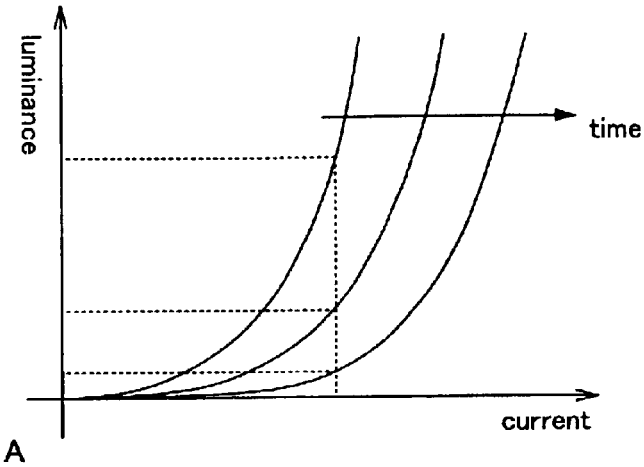
FIGS. 21A–21C are graphs representing the variations in luminance of the light emitting element due to deterioration.
Figure 21B:
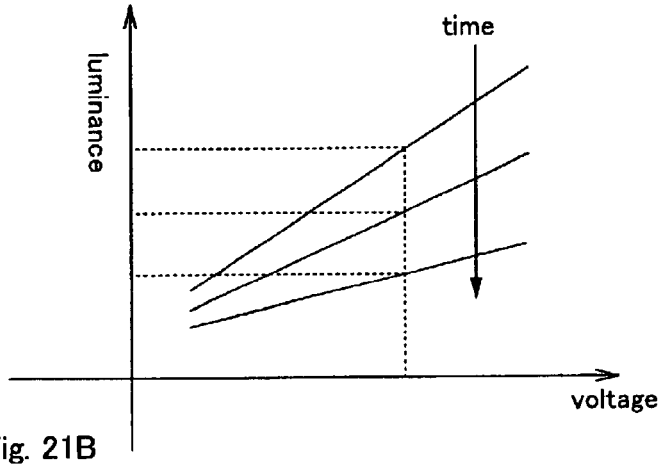
Figure 21C:
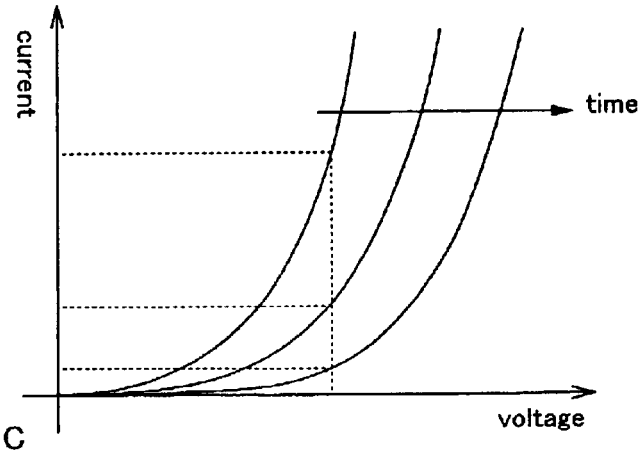

Now referring to FIG. 20, description is made on a relation between the respective lengths of the light emission periods (Ts) of the light emitting elements corresponding to the respective bits of the image signal and the gradation level of the light emitting element of the invention. FIG. 20 takes an example where the image signal consists of 3 bits and illustrates the durations of light emissions appearing in one frame period for displaying each of the 8 gradation levels of 0 to 7.

The individual bits of the 3-bit image signal correspond to three light emission periods Ts1 to Ts3, respectively. The arrangement of the light emission periods is expressed as Ts1:Ts2:Ts3=$2^2$:2:1. Although the embodiment is explained by way of the embodiment of the 3-bit image signal, the number of bits is not limited to this. In a case where an n-bit image signal is used, the ratio of the lengths of the light emission periods is expressed as Ts1:Ts2: . . . :Tsn−1:Tsn= $2^{n-1}$:$2^{n-2}$: . . . 2:1.

The gradation level is determined by the sum of the lengths of the durations of light emissions appearing in one frame period. In a case where the light emitting elements are luminescent for all the light emission periods, for example, the gradation level is at 7. Where the light emitting elements are non-luminescent for all the light emission periods, the gradation level is at 0.

It is assumed that the current is corrected in order to permit the pixels 201, 202 and 203 to display a gradation level 3, but that the pixel 203 achieves the gradation level 3 whereas the pixel 201 displays a gradation level 5 and the pixel 202 displays a gradation level 4. In this case, the gradation level of the pixel 201 is 2 steps higher, whereas the gradation level of the pixel 202 is 1 step higher.

Thus, the image signal correction circuit corrects the image signal to apply the pixel 201 with a corrected image signal of a gradation level 1 which is 2 steps lower then the desired gradation level 3, such that the light emitting element thereof may emit light only for the period of Ts3. On the other hand, the image signal correction circuit corrects the image signal to apply the pixel 202 with a corrected image signal of a gradation level 2 which is 1 step lower than the desired gradation level 3, such that the light emitting element thereof emits light only for the period of Ts2.

Although this embodiment illustrates the case where the correction is performed using the pixel with the greatest deterioration as reference, the invention is not limited to this. The designer may arbitrarily define the reference pixel and may arrange such that the image signal is corrected on an as-needed basis to accomplish coincidence of the gradation level with that of the reference pixel.

In a case where a pixel with the least deterioration is used as reference, the image signal is corrected based on the addition so that the correction on the display of white is ineffective. Specifically, when "111111" is inputted as a 6-bit image signal, for example, any further addition cannot be done. On the other hand, in a case where a pixel with the greatest deterioration is used as reference, the image signal is corrected based on subtraction. In contrast to the correction based on addition, an ineffective range of correction is for the display of black and hence, there is little influence. Specifically, when "000000" is inputted as a 6-bit image signal, any further subtraction is not needed and an exact display of black can be accomplished by a normal light emitting element and a deteriorated light emitting element (simply by placing the light emitting elements in a non-emission state). The method has a feature that spots of some step higher gradation levels than 0 neighboring a black spot can be substantially adequately displayed if a display unit is adapted to display data of a somewhat large number of bits. Both the methods are useful for increasing the number of gradation levels.

In an another effective approach, both the correction method based on addition and the correction method based on subtraction are used in combination as swithced at a given gradation level as boundary, for example, thereby compensating each other for the respective demerits thereof.

Embodiment 3

In Embodiment 3, the following description refers to the constitutions of a signal line drive circuit and a scanning line drive circuit provided for the light emitting device of the present invention.

Figure 6:
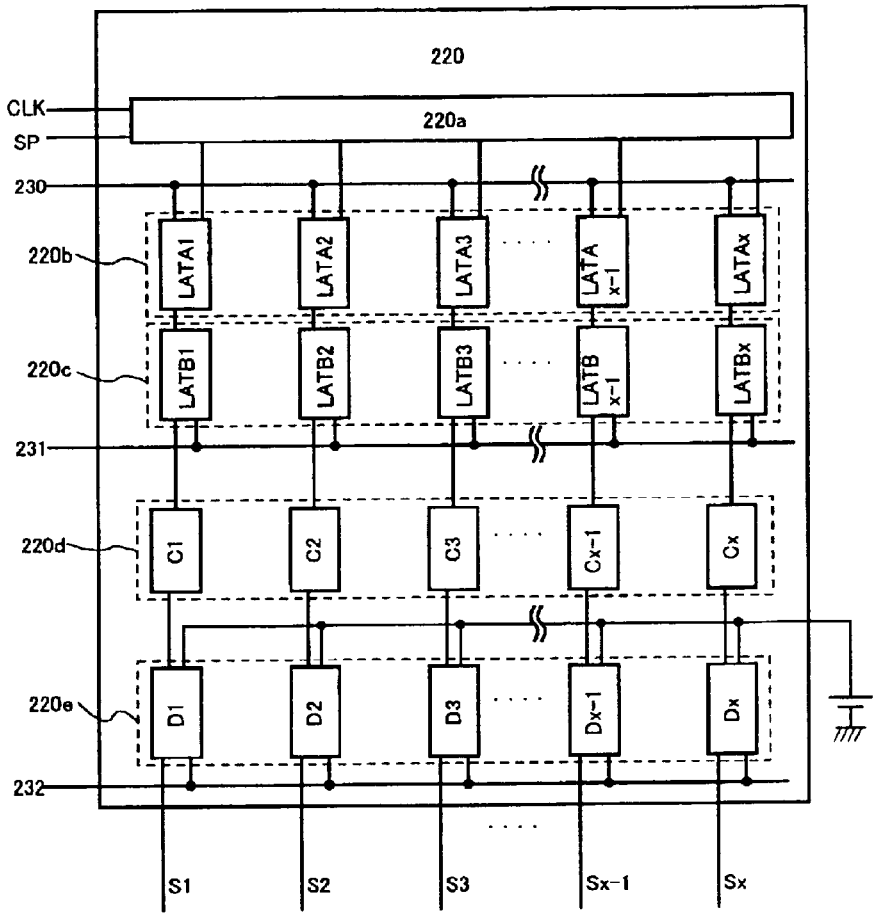
FIG. 6 is a block diagram showing a signal line drive circuit of the light emitting device according to the invention.

FIG. 6 exemplifies a schematic block diagram of a signal-line drive circuit 220 utilized for implementing the present invention. Reference numeral 220*a* designates a shift register, 220*b* a memory circuit A, 220*c* a memory circuit B, 220*d* a current converting circuit, and reference numeral 220*e* designates a select circuit.

A clock signal CLK and a start-up pulse signal SP are input to a shift register 220*a*. Digital image signals are input to a memory circuit A 220*b*, whereas a latch signal is input to another memory circuit B 220*c*. Further, select signals are input to a select circuit 220*e*. Operations of individual circuits are described below in accordance with the flow of signals.

Based on the inputs of the clock signal CLK and the start-up pulse signal SP to the shift register 220*a* via a predetermined wiring route, a timing signal is generated. The timing signal is then delivered to each of a plurality of latches A LATA_1–LATA_x included in a memory circuit A 220*b*. Alternatively, the timing signal generated in the shift register 220*a* may be input to a plurality of latches A LATA_1–LATA_x included in a memory circuit A 220*b* after amplifying the timing signal via a buffering means or the like.

When the memory circuit A 220*b* receives the timing signal, synchronously with the input timing signal, a plurality of digital image signals from digital video compensating circuits corresponding to one-bit are serially written into the above-referred plural latches A LATA_1–LATA_x for storage therein before eventually being delivered to a image signal line 230.

In this embodiment, a plurality of digital image signals are serially written into the memory circuit A 220*b* comprising LATA_1–LATA_x. However, the scope of the present invention is not solely limited to this arrangement. For example, it is also practicable to split plural stages of latches present in the memory circuit A 220*b* into plural groups in order to enable digital image signals to be simultaneously input to each of the individual groups in parallel with each other. This method is referred to as "division drive" for example. The number of the stages included in one group is referred to as the division number. For example, when the latches are split into plural groups of 4-stages, this is referred to as the four-division drive.

A period of time until the completion of a process to serially write plural digital image signals into the all stages of latches present in the memory circuit A 220*b* is called a line period. There is a case in which the line period refers to a period in which a horizontal retracing period is added to the line period.

After terminating one line period, latch signals are delivered to a plurality of latches B LATB_1–LATB_x held in another memory circuit B 220*c* via a latch signal line 231. Simultaneously, a plurality of digital image signals retained by a plurality of latches LATA_1–LATA_x present in the memory circuit A 220*b* are written all at once into a plurality of latches B LATB_1–LATB_x present in the above referred memory circuit B 220*c* for storage therein.

After fully delivering the retained digital image signals to the memory circuit B 220*c*, synchronously with the timing signal fed from the above shift register 220*a*, digital image signals corresponding to the following one bit are serially written into the memory circuit A 220*b*. During the second-round one-line period is underway, digital image signals stored in the memory circuit B 220*c* are delivered to a current converting circuit 220*d*.

The current converting circuit 220*d* comprises a plurality of current setting circuits C1–Cx. Based on the binary data of 1 or 0 of the digital image signals input to each of the current setting circuits C1–Cx, magnitude of signal current Ic of signals to be delivered to the following select circuit 220*e* is determined. Specifically, the signal current Ic is of such a magnitude just enough to cause a light emitting element to emit light or such a magnitude that does not cause the light emitting element to emit light.

In accordance with a select signal received from a select signal line 232, the select circuit 220*e* determines whether the above signal current IC should be fed to a corresponding signal line or a voltage that would cause the transistor Tr2 to turn ON should be fed to the corresponding signal line.

Figure 7:
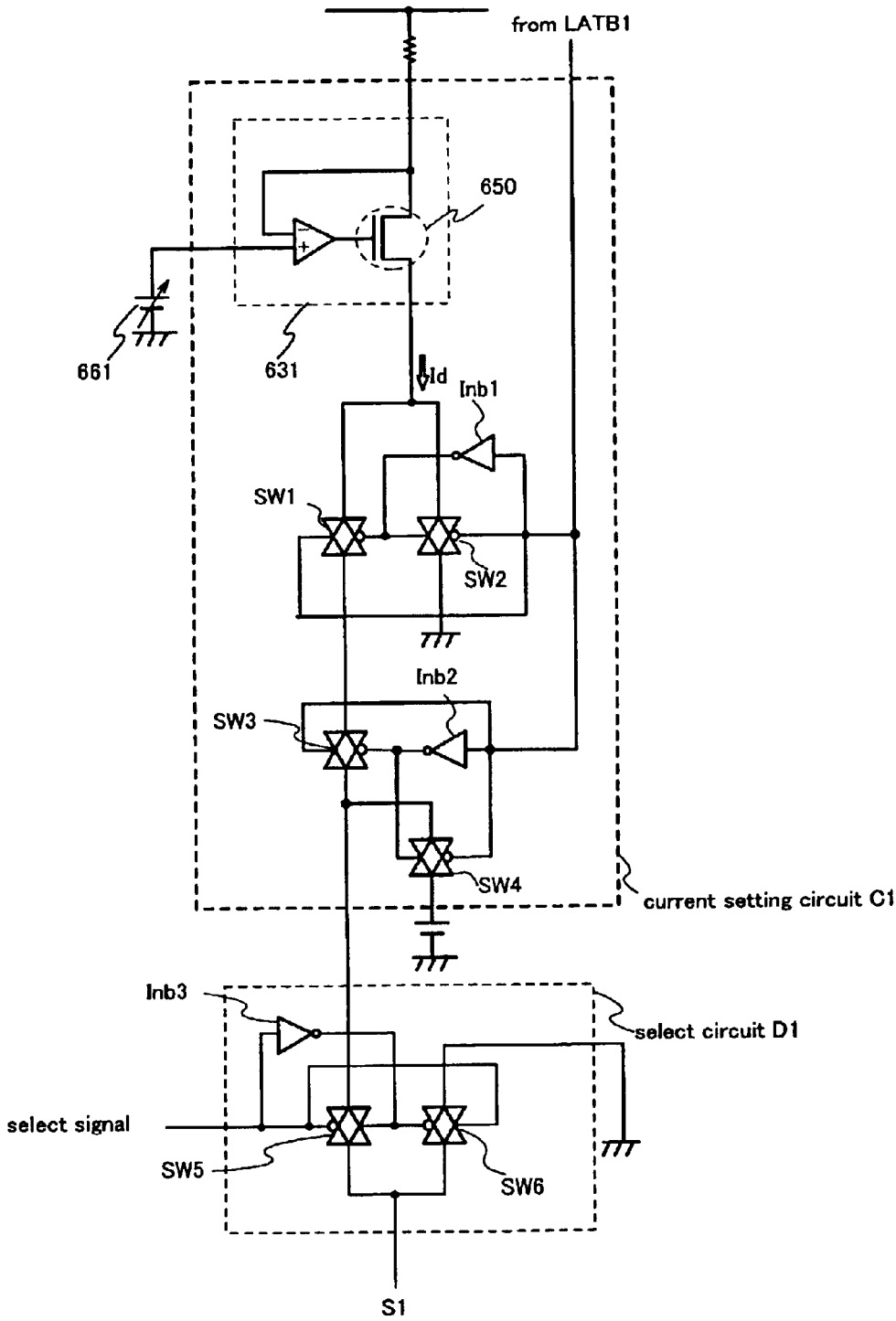
FIG. 7 is a circuit diagram showing a current setting circuit and a switching circuit.

FIG. 7 exemplifies concrete constitutions of the current setting circuit C1 and the select circuit D1 described above. It should be understood that each of current setting circuits C2–Cx has a constitution identical to that of the above current setting circuit C1. Likewise, each of current setting circuits D2–Dx has a constitution identical to that of a current setting circuit D1.

The current setting circuit C1 comprises the following: a current supply source 631, four transmission gates SW1–SW4, and a pair of inverters Inb1 and Inb2. It should be noted that polarity of a transistor 650 provided for the current supply source 631 is identical to those of the above-referred transistors Tr1 and Tr2 provided for an individual pixel.

In the light emitting device based by the present invention, variable power supply 661 is controlled by a current compensating circuit, thereby changing the voltage supplied to an non-inversion input terminal of an operational amplifier stored in the current supply source 631, as a result, magnitude of current fed to SW1 and SW2 from the current supply source 631 can be controlled. In addition, for the current supply source 631, it is not solely limited to the constitution as described above, operations of controlling the magnitude of output current can be difference in accordance with the constitution of the current supply source.

Switching operations of the transmission gates SW1–SW4 are controlled by the digital image signal output from the latch LATB_1 present in the memory circuit B 220*c*. Those digital image signals delivered to the transmission gates SW1 and SW3 and those digital image signals delivered to the transmission gates SW2 and SW4 are respectively inverted by the inverters Inb1 and Inb2. Because of this arrangement, while the transmission gates SW1 and SW3 remain ON, transmission gates SW2 and SW4 are turned OFF, and vice versa.

While the transmission gates SW1 and SW3 remain ON, current Id of a predetermined value other than 0 is fed from the current supply source 631 to the select circuit D1 as signal current Ic via the transmission gates SW1 and SW3.

Conversely, while the transmission gates SW2 and SW4 are held ON, current Id output from the current supply source 631 is grounded via the transmission gate SW2. Further, power supply voltage flowing through power supply lines V1–Vx is applied to the select circuit D1 via the transmission gate SW4, thereby entering into a condition where IC≈0

The select circuit D1 comprises a pair of transmission gates SW5 and SW6 and an inverter Inb3. Switching operations of the transmission gates SW5 and SW6 are controlled by switching signals. Polarities of the switching signals respectively fed to the transmission gates SW5 and SW6 are inverted with respect to each other by the inverter Inb3, and thus, while the transmission gate SW5 remains ON, the other date SW6 remains OFF, and vice versa. While the transmission gate SW5 remains ON, the above signal current Ic is delivered to the signal line S1. While the transmission gate SW6 remains ON, a voltage sufficient to turn ON the above transistor Tr2 is fed to the signal line S1.

Referring to FIG. 6 again, the above serial processes are simultaneously executed within one-line period in all the current setting circuits C1–Cx present in the current converting circuit 220*d*. As a result, actual value of the signal current Ic to be delivered to all the signal lines is selected by the corresponding digital image signals.

Constitution of the drive circuit used for embodying the present invention is not solely limited to those which are cited in the above description. Further, the current converting circuit exemplified in the above description is not solely limited to the structure shown in FIG. 7. Insofar as the current converting circuit utilized for the present invention is capable of enabling digital image signals to be used to select either of binary values that the signal current Ic may take and then feeding a signal current bearing the selected value to a signal line, any constitution may be employed therefor. Further, insofar as a select circuit can select either to feed signal current Ic to a signal line or to deliver a certain voltage sufficient to turn ON the transistor Tr2 to the signal line, any constitution may also be employed for the select circuit in addition to that shown in FIG. 7.

In place of a shift register, it is also practicable to utilize a different circuit like a decoder circuit capable of selecting any of signal lines.

Next, constitution of a scanning line drive circuit is described below.

Figure 8:
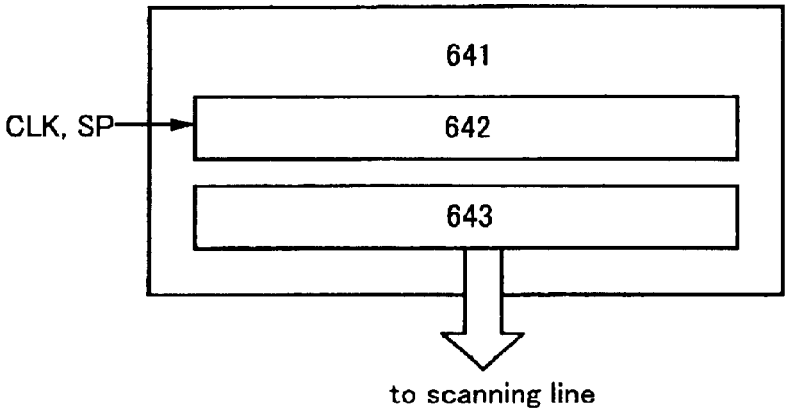
FIG. 8 is a block diagram showing scanning line drive circuit of the light emitting device according to the invention.

FIG. 8 exemplifies a block diagram of a scanning line drive circuit 641 comprising a shift register 642 and a buffer circuit 643. If deemed necessary, a level shifter may also be provided.

In the scanning line drive circuit 641, upon the input of a clock signal CLK and a start-up pulse signal SP, a timing signal is generated. The generated timing signal is buffered and amplified by the buffer circuit 643 and then delivered to a corresponding scanning line.

A plurality of gates of those transistors composing pixels corresponding one-line are connected to individual scanning lines. Since it is required to simultaneously turn ON a plurality of transistors included in pixels corresponding to one line, the buffer circuit 643 is capable of accommodating flow of a large current.

It should be noted that constitution of the scanning line drive circuit 641 provided for the light emitting device of the present invention is not solely limited to the one shown in FIG. 8. For example, in place of the above-referred shift register, it is also practicable to utilize a different circuit like a decoder circuit capable of selecting any of scanning lines.

The constitution based on this embodiment may also be realized by being freely combined with Embodiment 1 or 2.

Embodiment 4

In the light emitting device according to the embodiment of the invention, the deterioration correction unit is formed on a different substrate from the substrate where the pixel portion is provided. The image signal supplied to the light emitting device is subjected to the correction in the image signal correction circuit and then inputted to the signal line drive circuit via FPC, the signal line drive circuit formed on the same substrate that includes the pixel portion. The merit of such a method is that the deterioration correction unit features compatibility by virtue of the unit design, thus permitting the direct use of a general light emitting panel. This embodiment illustrates an approach where the deterioration correction unit is formed on the same substrate that includes the pixel portion, the signal line drive circuit and the scanning line drive circuit, thereby achieving the cost reduction because of a notably decreased number of components, the space saving and the high speed operation.

Figure 9:
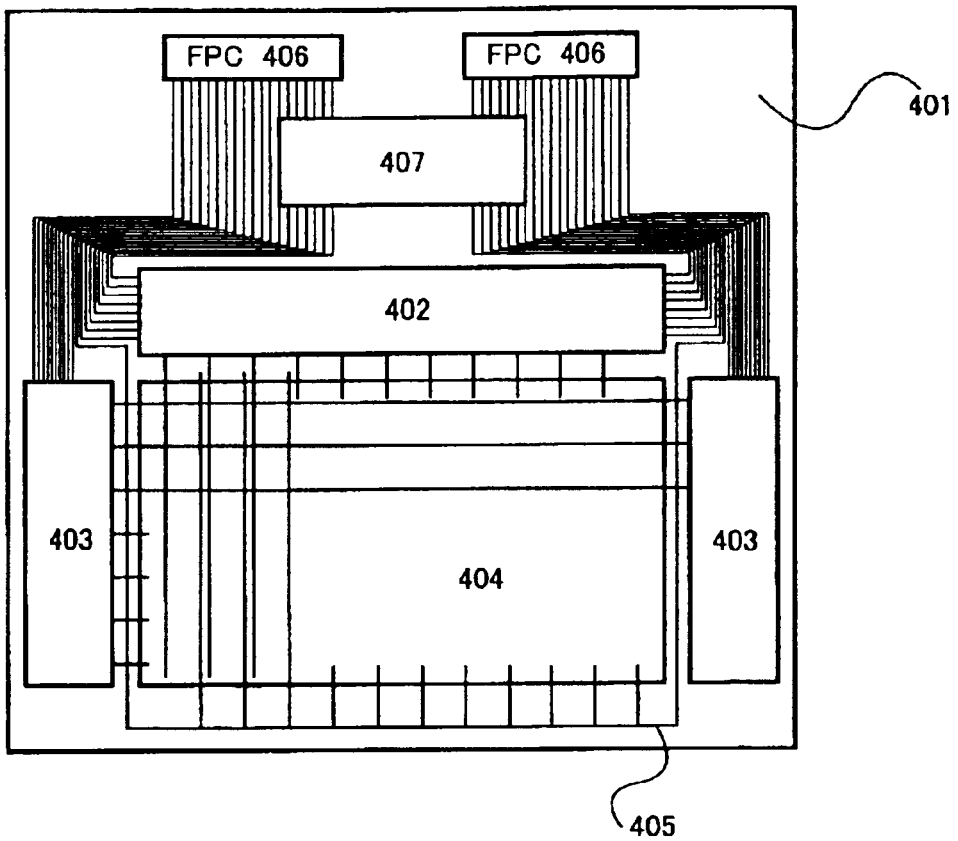
FIG. 9 is a block diagram showing a light emitting device according to the invention.

FIG. 9 shows an arrangement of a light emitting device according to the invention wherein the deterioration correction unit as well as the pixel portion, signal line drive circuit and scanning line drive circuit are integrally formed on the same substrate. A signal line drive circuit 402, a scanning line drive circuit 403, a pixel portion 404, a power line 405, an FPC 406 and a deterioration correction unit 407 are integrally formed on a substrate 401. Needless to say, a layout on the substrate is not limited to the embodiment shown in the figure. However, it is favorable that the individual blocks are arranged in close adjacency with one another with the layout of the signal line and the like or the wiring length thereof taken into consideration.

The image signal from an external image source is inputted to the image signal correction circuit of the deterioration correction unit 407 via the FPC 406. Subsequently, the corrected image signal is inputted to the signal line drive circuit 402.

In the current correction circuit of the deterioration correction unit, on the other hand, an amount of current outputted from a current source of the signal line drive circuit is corrected. According to the embodiment, the amount of current output from the current source of the signal line drive circuit is corrected by means of the current correction circuit, but the embodiment is not limited to this arrangement. The current source for controlling the amount of current through the light emitting element need not necessarily be disposed in the signal line drive circuit.

In the embodiment shown in FIG. 9, the deterioration correction unit 407 is disposed between the FPC 406 and the signal line drive circuit 402 so that the routing of a control signal is facilitated.

This embodiment may be practiced in combination with any of Embodiments 1 to 3.

Embodiment 5

In this embodiment, a configuration of a pixel included in the light emitting device of the invention is described with reference to circuit diagrams shown in FIGS. 10 to 12.

Figure 10A:
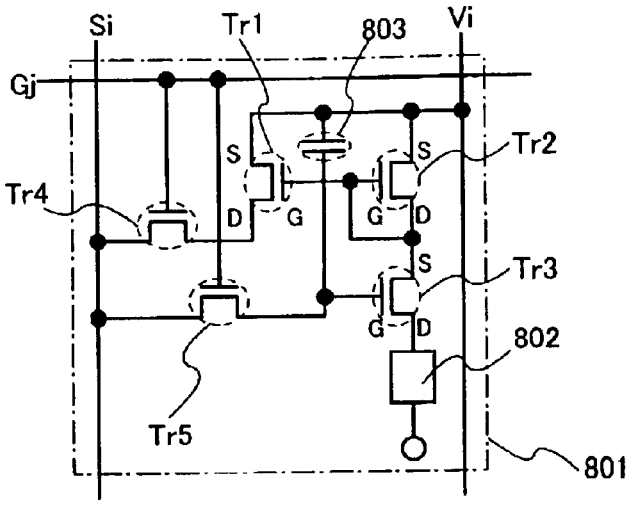
FIGS. 10A–10C are diagrams each showing a pixel circuit of the light emitting device according to the invention.

A pixel 801 according to the embodiment shown in FIG. 10A includes a signal line Si (one of S1 to Sx), a first scanning line Gj (one of G1 to Gy), and a power line Vi (one of V1 to Vx). The pixel 801 further includes transistors Tr1, Tr2, Tr3, Tr4 and Tr5, a light emitting element 802 and a capacitance 803. Although not necessarily required, the capacitance 803 is provided for more positively retaining a voltage (gate voltage) across the gates and sources of the transistors Tr1 and Tr2. It is noted that the voltage herein is defined to mean a potential difference from the ground unless otherwise particularly described.

Both the transistors Tr4 and Tr5 have their gates connected to the scanning line Gj. The source and drain of the transistor Tr4 are connected to the signal line Si and to the drain of the transistor Tr1, respectively. The source and drain of the transistor Tr5 are connected to the signal line Si and to the gate of the transistor Tr3, respectively.

The transistors Tr1 and Tr2 have their gates connected to each other. The sources of the transistors Tr1 and Tr2 are both connected to the power line Vi. The transistor Tr2 has its gate and drain interconnected and the drain thereof is further connected to the source of the transistor Tr3.

The transistor Tr3 has its drain connected to a pixel electrode of the light emitting element 802. The light emitting element 802 has an anode and a cathode. In this specification, the cathode is referred to as a counter electrode if the anode is used as the pixel electrode, whereas the anode is referred to as the counter electrode if the cathode is used as the pixel electrode.

The transistors Tr4 and Tr5 may be of n-channel type or of p-channel type, provided that the transistors Tr4 and Tr5 have the same polarity.

On the other hand, the transistors Tr1, Tr2 and Tr3 may be of n-channel type or of p-channel type, provided that the transistors Tr1, Tr2 and Tr3 have the same polarity. The transistors Tr1, Tr2 and Tr3 may preferably be of p-channel type if the anode is used as the pixel electrode and the cathode is used as the counter electrode. Conversely, if the anode is used as the counter electrode and the cathode is used as the pixel electrode, the transistors Tr1, Tr2 and Tr3 may preferably be of n-channel type.

The capacitance 803 have two electrodes thereof connected to the gate of the transistor Tr3 and to the power line vi, respectively. Although not necessarily required, the capacitance 803 is provided for more positively retaining the voltage (gate voltage) across the gate and source of the transistor Tr3. Additionally, a capacitance may also be provided for more positively retaining the gate voltage of the transistors Tr1 and Tr2.

In the pixel shown in FIG. 10A, a current supplied to the signal line is controlled by way of the current source included in the signal line drive circuit, whereas the deterioration correction unit serves to correct the amount of current output from the current source. The gradation level of the pixel is corrected by controlling the light emission period of the light emitting element 802 by means of an image signal corrected by the deterioration correction unit.

Figure 10B:
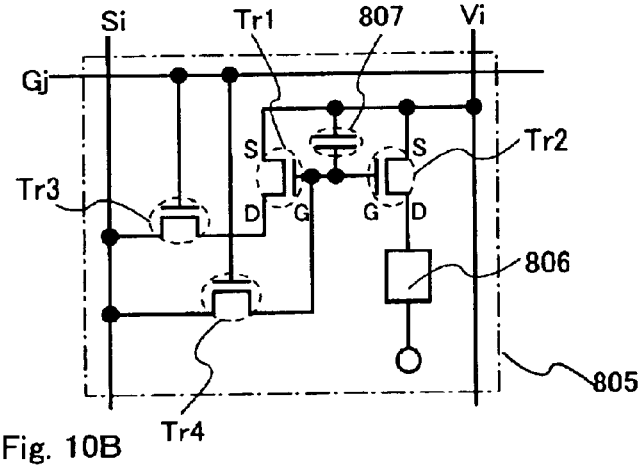

A pixel 805 shown in FIG. 10B includes the signal line Si (one S1 to Sx), the first scanning line Gj (one of G1 to Gy), and the power line Vi (one of V1 to Vx). The pixel 805 further includes the transistors Tr1, Tr2, Tr3 and Tr4, a light emitting element 806, and a capacitance 807. Although not necessarily required, the capacitance 807 is provided for more positively retaining a voltage (gate voltage) across a respective pair of gate and source of the transistors Tr1 and Tr2.

The transistor Tr3 has its gate connected to the first scanning line Gj. The source and drain of the transistor Tr3 are connected to the signal line Si and to the drain of the transistor Tr1, respectively.

The transistor Tr4 has its gate connected to the first scanning line Gj. The source and drain of the transistor Tr4 are connected to the signal line Si and to the gates of the transistors Tr1 and Tr2, respectively.

The transistors Tr1 and Tr2 have their gates connected to each other, and their sources connected to the power line Vi. The drain of the transistor Tr2 is connected to a pixel electrode of the light emitting element 806. The capacitance 807 has two electrodes, one of which is connected to the gates of the transistors Tr1 and Tr2 and the other one of which is connected to the power line Vi.

The light emitting element 806 includes an anode and a cathode. The counter electrode is maintained at a given voltage level.

The transistors Tr1 and Tr2 may be of n-channel type or of p-channel type, provided that the transistors Tr1 and Tr2 have the same polarity. The transistors Tr1 and Tr2 may preferably of p-channel type if the anode is used as the pixel electrode and the cathode is used as the counter electrode. Conversely, if the anode is used as the counter electrode and the cathode is used as the pixel electrode, the transistors Tr1 and Tr2 may preferably of n-channel type.

The transistors Tr3 and Tr4 may be of n-channel type or of p-channel type, provided that the transistors Tr3 and Tr4 have the same polarity.

In the pixel shown in FIG. 10B, the current supplied to the signal line is controlled by means of the current source included in the signal line drive circuit, whereas the deterioration correction unit serves to correct the amount of current output from the current source. The gradation level of the pixel is corrected by controlling the light emission period of the light emitting element 806 by means of the image signal corrected by the deterioration correction unit.

Figure 10C:
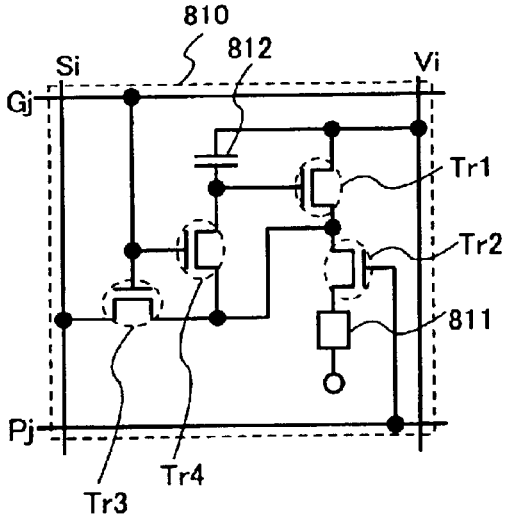

A pixel 810 shown in FIG. 10C includes the signal line Si (one of S1 to Sx), the first scanning line Gj (one of G1 to Gy), a second scanning line Pj (one of P1 to py), and the power line Vi (one of V1 to Vx). The pixel 810 further includes the transistors Tr1, Tr2, Tr3 and Tr4, a light emitting element 811, and a capacitance 812.

The transistors Tr3 and Tr4 have their gates connected to the first scanning line Gj. The source and drain of the transistor Tr3 are connected to the signal line Si and to the source of Tr2, respectively. The source and drain of Tr4 are connected to the source of Tr2 and to the gate of Tr1, respectively. That is, either one of the source and drain of Tr3 is connected to either one of the source and drain of Tr4.

Tr1 has its source connected to the power line Vi and its drain connected to the source of Tr2. Tr2 has its gate connected to the second scanning line Pj and its drain connected to a pixel electrode included in the light emitting element 811. The light emitting element 811 includes the pixel electrode, a counter electrode, and an organic light emitting layer disposed between the pixel electrode and the counter electrode. The counter electrode of the light emitting element 811 is applied with a given voltage from a voltage source disposed externally of a light emitting panel.

Tr3 and Tr4 may be of n-channel type or of p-channel type, provided that Tr3 and Tr4 have the same polarity. Tr1 may be an n-channel type TFT or p-channel type TFT, whereas Tr2 may be an n-channel type TFT or p-channel type TFT. As to the pixel electrode and counter electrode of the light emitting element, either one comprises an anode whereas the other comprises a cathode. In a case where Tr2 is a p-channel type TFT, it is preferred that the anode is used as the pixel electrode and the cathode is used as the counter electrode. Conversely, in a case where Tr2 is an n-channel type TFT, it is preferred that the cathode is used as the pixel electrode and the anode is used as the counter electrode.

The capacitance 812 is provided between the gate and source of Tr1. Although not necessarily required, the capacitance 812 is provided for more positively retaining a voltage ($V_{GS}$) across the gate and source of Tr1.

In the pixel shown in FIG. 10C, the current supplied to the signal line is controlled by means of the current source included in the signal line drive circuit, whereas the deterioration correction unit serves to correct the amount of current output from the current source. The gradation level of the pixel is corrected by controlling the light emission period of the light emitting element 811 by means of the image signal corrected by the deterioration correction unit.

Figure 11A:
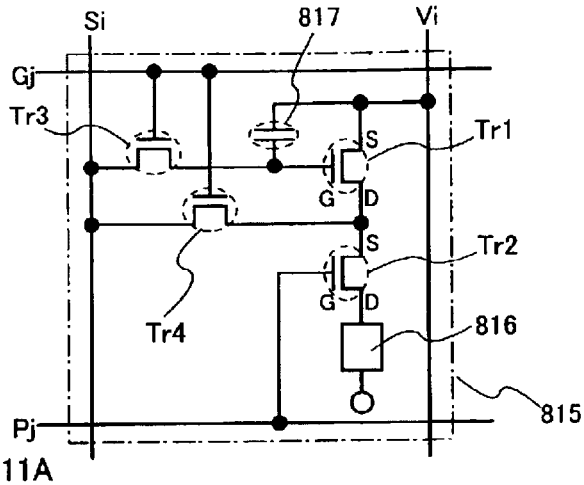
FIGS. 11A–11C are diagrams each showing a pixel circuit of the light emitting device according to the invention.

A pixel 815 shown in FIG. 11A includes the signal line Si (one of S1 to Sx), the first scanning line Gj (one of G1 to Gy), the second scanning line Pj (one of P1 to Py) and the power line Vi (one of V1 to Vx). The pixel further includes the transistors Tr1, Tr2, Tr3 and Tr4, a light emitting element 816, and a capacitance 817.

The transistors Tr3 and Tr4 have their gates connected to the first scanning line Gj. The source and drain of the transistor Tr3 are connected to the signal line Si and to the gate of the transistor Tr1, respectively. The source and drain of the transistor Tr4 are connected to the signal line Si and to the drain of the transistor Tr1, respectively.

The transistor Tr1 has its source connected to the power line Vi and its drain connected to the source of the transistor Tr2. The transistor Tr2 has its gate connected to the second scanning line Pj and its drain connected to a pixel electrode included in the light emitting element 816. The counter electrode of the light emitting element is maintained at a given voltage level.

The transistors Tr3 and Tr4 may be of n-channel type or of p-channel type, provided that the transistors Tr3 and Tr4 have the same polarity.

The transistors Tr1 and Tr2 may be of n-channel type or of p-channel type, provided that the transistors Tr1 and Tr2 have the same polarity. The transistors Tr1 and Tr2 may preferably be p-channel type transistors if the anode is used as the pixel electrode and the cathode is used as the counter electrode. Conversely, the transistors Tr1 and Tr2 may preferably be n-channel type transistors if the anode is used as the counter electrode and the cathode is used as the pixel electrode.

The capacitance 817 is provided between the gate and source of the transistor Tr1. Although not necessarily required, the capacitance 817 is provided for (more positively) retaining a voltage (gate voltage) across the gate and source of the transistor Tr1.

In the pixel shown in FIG. 11A, the current supplied to the signal line is controlled by means of the current source included in the signal line drive circuit, whereas the deterioration correction unit serves to correct the amount of current output from the current source. The gradation level of the pixel is corrected by controlling the light emission period of the light emitting element 815 by means of the image signal corrected by the deterioration correction unit.

Figure 11B:
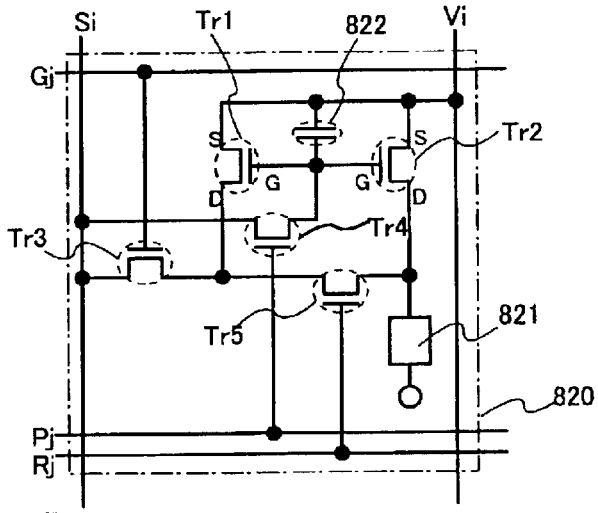

A pixel 820 shown in FIG. 11B includes the signal line Si (one of S1 to Sx), the first scanning line Gj (one of G1 to Gy), the second scanning line Pj (one of P1 to Py), a third scanning line Rj (one of R1 to Ry), and the power line Vi (one of V1 to Vx).

The pixel 820 further includes the transistors Tr1, Tr2, Tr3, Tr4 and Tr5, a light emitting element 821 and a capacitance 822. Although not necessarily required, the capacitance 822 is provided for more positively retaining a voltage (gate voltage) across a respective pair of gate and source of the transistors Tr1 and Tr2.

The transistor Tr3 has its gate connected to the first scanning line Gj. The source and drain of the transistor Tr3 are connected to the signal line Si and to the drain of the transistor Tr1, respectively.

The transistor Tr4 has its gate connected to the second scanning line Pj. The source and drain of the transistor Tr4 are connected to the signal line Si and to the gates of the transistors Tr1 and Tr2, respectively.

The transistor Tr5 has its gate connected to the third scanning line Rj. The source and drain of the transistor Tr5 are connected to the drain of the transistor Tr1 and to the drain of the transistor Tr2, respectively.

The transistors Tr1 and Tr2 have their gates connected to each other and their sources connected to the power line Vi. The drain of the transistor Tr2 is connected to the pixel electrode of the light emitting element 821. The counter electrode is maintained at a given voltage level.

The capacitance 822 has two electrodes, one of which is connected to the gates of the transistors Tr1 and Tr2 and the other one of which is connected to the power line Vi.

The transistors Tr1 and Tr2 may be of n-channel type or of p-channel type, provided that the transistors Tr1 and Tr2 have the same polarity. The transistors Tr1 and Tr2 may preferably be of p-channel type if the anode is used as the pixel electrode and the cathode is used as the counter electrode. Conversely, if the cathode is used as the pixel electrode and the anode is used as the counter electrode, the transistors Tr1 and Tr2 may preferably be of n-channel type.

The transistors Tr3, Tr4 and Tr5 may be of n-channel type or p-channel type.

In the pixel shown in FIG. 11B, the current supplied to the signal line is controlled by means of the current source included in the signal line drive circuit, whereas the deterioration correction unit serves to correct the amount of current output from the current source. The gradation level of the pixel is corrected by controlling the light emission period of the light emitting element 821 by means of the image signal corrected by the deterioration correction unit.

Figure 11C:
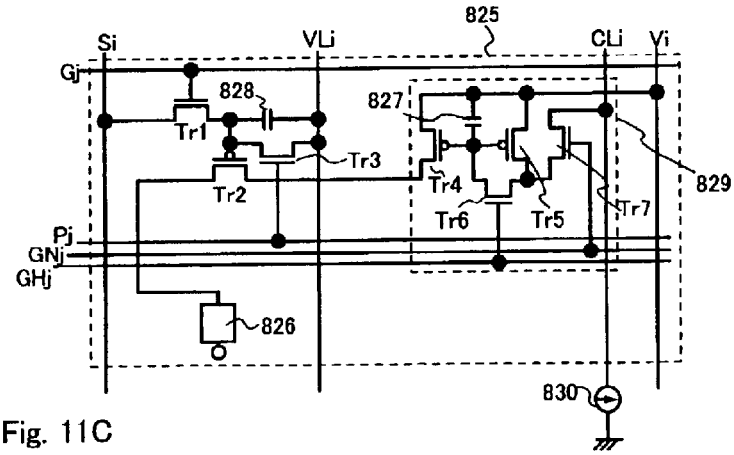

A pixel 825 shown in FIG. 11C includes the signal line Si (one of S1 to Sx), the first scanning line Gj (one of G1 to Gy), the second scanning line Pj (one of P1 to Py), a third scanning line GNj (one of GN1 to GNy), a second scanning line GHj (one of GH1 to GHy), a first power line Vi (one of V1 to Vx), a second power line VLi (one of VL1 to Vlx) and a current line CLi (one of CL1 to CLx). The pixel 825 further includes the transistors Tr1, Tr2, Tr3, Tr4, Tr5, Tr6 and Tr7, a light emitting element 826 and capacitances 827 and 828.

The transistor Tr1 has its gate connected to the first scanning line Gj. The source and drain of Tr1 are connected to the signal line Si and to the gate of Tr2, respectively. Tr3 has its gate connected to the second scanning line Pj. The source and drain of Tr3 are connected to the second power line VLi and to the gate of Tr2, respectively. The capacitance 828 is provided between the gate of Tr2 and the second power line VLi.

Tr4, Tr5, Tr6 and Tr7 constitute a current source 829. Tr4 and Tr5 have their gates connected to each other and their sources connected to the first power line Vi. Tr7 has its gate connected to the third scanning line GNj. The source and drain of Tr7 are connected to the current line CLi and to the drain of Tr5, respectively. Tr6 has its gate connected to the second scanning line GHj. The source and drain of Tr6 are connected to the gates of Tr4 and Tr5, and to the drain of Tr5, respectively. The capacitance 827 is provided between the gates of Tr4 and Tr5 and the first power line Vi. The source and drain of Tr2 are connected to the drain of Tr4 and to the pixel electrode of the light emitting element 826, respectively.

In the pixel shown in FIG. 11C, an image signal corrected by the deterioration correction unit is supplied to the signal line Si, whereas a current supplied from the current source 850 to the current line CLi is corrected by the deterioration correction unit.

Figure 12A:
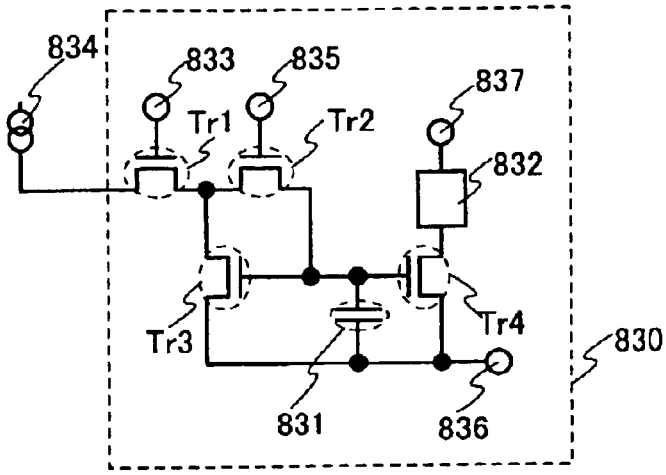
FIGS. 12A and 12B are diagrams each showing a pixel circuit of the light emitting device according to the invention.

A pixel 830 shown in FIG. 12A includes the transistors Tr1, Tr2, Tr3 and Tr4, a capacitance 831 and a light emitting element 832.

Tr1 has its gate connected to a terminal 833. The source and drain of Tr1 are connected to a current source 834 included in the signal line drive circuit and to the drain of Tr3, respectively. Tr2 has its gate connected to a terminal 835. The source and drain of Tr2 are connected to the drain of Tr3 and to the gate of Tr3, respectively. That is, Tr3 and Tr4 have their gates connected to each other and their sources connected to a terminal 836. The drain of Tr4 is connected to the anode of the light emitting element 832, the cathode of which is connected to a terminal 837. The capacitance 831 is so provided as to retain a voltage across a respective pair of gate and source of Tr3 and Tr4. The terminals 836 and 837 are each applied with a predetermined voltage from each power source, thus having a voltage difference therebetween.

In the pixel shown in FIG. 12A, the current output from the current source 834 is controlled by means of the deterioration correction unit, which serves to correct the amount of current outputted from the current source 834. The gradation level of the pixel is corrected by controlling the light emission period of the light emitting element 832 by means of the image signal corrected by the deterioration correction unit.

Figure 12B:
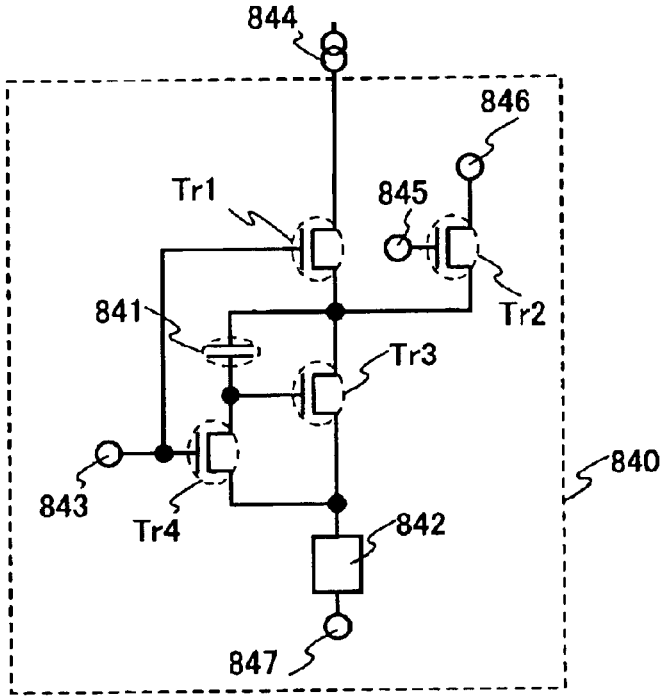

A pixel 840 shown in FIG. 12B includes the transistors Tr1, Tr2, Tr3 and Tr4, a capacitance 841 and a light emitting element 842.

Tr1 has its gate connected to a terminal 843. The source and drain of Tr1 are connected to a current source 844 included in the signal line drive circuit, and to the source of Tr3, respectively. Tr4 has its gate connected to the terminal 843. The source and drain of Tr4 are connected to the gate of Tr3 and to the drain of Tr3, respectively. Tr2 has its gate connected to a terminal 845. The source and drain of Tr2 are connected to a terminal 846, and to the source of Tr3, respectively. Tr4 has its drain connected the anode of the light emitting element 842, the cathode of which is connected to a terminal 847. The capacitance 841 is so provided as to retain a voltage across the gate and source of Tr3. The terminals 846 and 847 are each applied with a predetermined voltage from each power source, thus having a voltage difference therebetween.

In the pixel shown in FIG. 12B, the current output from the current source 844 is controlled by means of the deterioration correction unit, which serves to correct the amount of current outputted from the current source 844. The gradation level of the pixel is corrected by controlling the light emission period of the light emitting element 842 by means of the image signal corrected by the deterioration correction unit.

The embodiment of the invention may be practiced in combination with any one of Embodiments 1 to 4.

Embodiment 6

In Embodiment 6, the manufacturing method of the light emitting device of the present invention is described. Note that in Embodiment 6, the manufacturing method of a pixel element illustrated in FIG. 10B is described as an embodiment. Further note that the manufacturing method of the present invention can be applied to pixel portions having other constitutions of the present invention. Further, although in Embodiment 6, a sectional view of the pixel element having transistors Tr 2 and Tr 3 is illustrated, transistors Tr 1 and Tr 4 also can be manufactured refer to the manufacturing method of Embodiment 6. And, in Embodiment 6, an example in which driving circuits (signal line driving circuit and scanning line driving circuit) provided on the perimeter of a pixel portion having TFTs are formed with TFTs of the pixel portion simultaneously on the same substrate is shown.

Figures 13A, 13B, 13C:
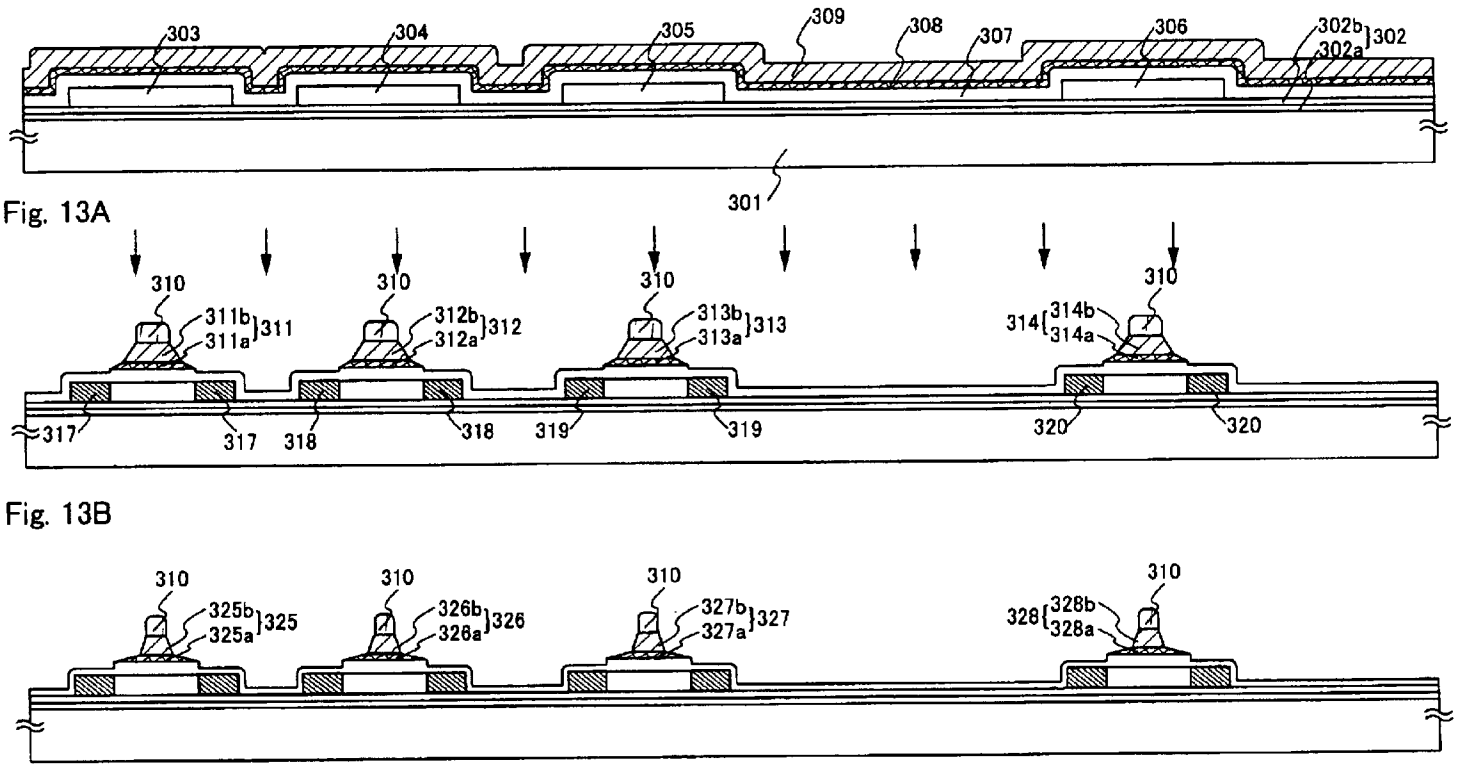
FIGS. 13A–13C are diagrams illustrating a method for fabricating the light emitting device according to the invention.

First, as shown in FIG. 13A, a base film 302 consist of an insulating film such as a silicon oxide film, a silicon nitride film or a silicon oxynitride film is formed on a substrate 301 consist of glass such as barium borosilicate glass or alumino borosilicate glass represented by #7059 glass and #1737 glass of Coning Corporation. For example, a silicon oxynitride film 302*a* formed from $SiH_4$, $NH_3$ and $N_2O$ by the plasma CVD method and having a thickness of from 10 to 200 nm (preferably 50 to 100 nm) is formed. Similarly, a hydrogenerated silicon oxynitride film formed from $SiH_4$ and $N_2O$ and having a thickness of from 50 to 200 nm (preferably 100 to 150 nm) is layered thereon. In this embodiment, the base film 302 has a two-layer structure, but may also be formed as a single layer film of one of the above insulating films, or a laminate film having more than two layers of the above insulating films.

Island-like semiconductor layers 303 to 306 are formed from a crystalline semiconductor film obtained by conducting laser crystallization method or a known thermal crystallization method on a semiconductor film having an amorphous structure. Each of these island-like semiconductor layers 303 to 306 has a thickness of from 25 to 80 nm (preferably 30 to 60 nm). No limitation is put on the material of the crystalline semiconductor film, but the crystalline semiconductor film is preferably formed from silicon, a silicon germanium (SiGe) alloy, etc.

When the crystalline semiconductor film is to be manufactured by the laser crystallization method, an excimer laser, a YAG laser and an $YVO_4$ laser of a pulse oscillation type or continuous light emitting type are used. When these lasers are used, it is preferable to use a method in which a laser beam radiated from a laser oscillator is converged into a linear shape by an optical system and then is irradiated to the semiconductor film. A crystallization condition is suitably selected by an operator. When the excimer laser is used, pulse oscillation frequency is set to 300 Hz, and laser energy density is set to from 100 to 400 mJ/cm$^2$ (typically 200 to 300 mJ/cm$^2$). When the YAG laser is used, pulse oscillation frequency is preferably set to from 30 to 300 kHz by using its second harmonic, and laser energy density is preferably set to from 300 to 600 mJ/cm$^2$ (typically 350 to 500 mJ/cm$^2$). The laser beam converged into a linear shape and having a width of from 100 to 1000 μm, e.g. 400 μm is, is irradiated to the entire substrate surface. At this time, overlapping ratio of the linear laser beam is set to from 50 to 90%.

Note that, a gas laser or solid state laser of continuous oscillation type or pulse oscillation type can be used. The gas laser such as an excimer laser, Ar laser, Kr laser and the solid state laser such as YAG laser, $YVO_4$ laser, YLF laser, $YAlO_3$ laser, glass laser, ruby laser, alexandrite laser, Ti: sapphire laser can be used as the laser beam. Also, crystals such as YAG laser, $YVO_4$ laser, YLF laser, $YAlO_3$ laser wherein Cr, Nd, Er, Ho, Ce, Co, Ti or Tm is doped can be used as the solid state laser. A basic wave of the lasers is different depending on the materials of doping, therefore a laser beam having a basic wave of approximately 1 μm is obtained. A harmonic corresponding to the basic wave can be obtained by the using non-linear optical elements.

Further, after an infrared laser light emitted from the solid state laser changes to a green laser light by a non linear optical element, an ultraviolet laser light obtained by another non linear optical element can be used.

When a crystallization of an amorphous semiconductor film is conducted, it is preferable that the second harmonic through the fourth harmonic of basic waves is applied by using the solid state laser which is capable of continuous oscillation in order to obtain a crystal in large grain size. Typically, it is preferable that the second harmonic (with a thickness of 532 nm) or the third harmonic (with a thickness of 355 nm) of an Nd: $YVO_4$ laser (basic wave of 1064 nm) is applied. Specifically, laser beams emitted from the continuous oscillation type $YVO_4$ laser with 10 W output is converted into a harmonic by using the non-linear optical elements. Also, a method of emitting a harmonic by applying crystal of $YVO_4$ and the non-linear optical elements into a resonator. Then, more preferably, the laser beams are formed so as to have a rectangular shape or an elliptical shape by an optical system, thereby irradiating a substance to be treated. At this time, the energy density of approximately 0.01 to 100 MW/cm$^2$ (preferably 01. to 10 MW/cm$^2$) is required. The semiconductor film is moved at approximately 10 to 2000 cm/s rate relatively corresponding to the laser beams so as to irradiate the semiconductor film.

Next, a gate insulating film 307 covering the island-like semiconductor layers 303 to 306 is formed. The gate insulating film 307 is formed from an insulating film containing silicon and having a thickness of from 40 to 150 nm by using the plasma CVD method or a sputtering method. In this embodiment, the gate insulating film 5007 is formed from a silicon oxynitride film with a thickness of 120 nm. However, the gate insulating film is not limited to such a silicon oxynitride film, but it may be an insulating film containing other silicon and having a single layer or a laminated layer structure. For example, when a silicon oxide film is used, TEOS (Tetraethyl Orthosilicate) and $O_2$ are mixed by the plasma CVD method, the reaction pressure is set to 40 Pa, the substrate temperature is set to from 300 to 400° C., and the high frequency (13.56 MHz) power density is set to from 0.5 to 0.8 W/cm$^2$ for electric discharge. Thus, the silicon oxide film can be formed by discharge. The silicon oxide film manufactured in this way can then obtain preferable characteristics as the gate insulating film by thermal annealing at from 400 to 500° C.

A first conductive film 308 and a second conductive film 309 for forming a gate electrode are formed on the gate insulating film 307. In this embodiment, the first conductive film 308 having a thickness of from 50 to 100 nm is formed from Ta, and the second conductive film 309 having a thickness of from 100 to 300 nm is formed from W.

The Ta film is formed by a sputtering method, and the target of Ta is sputtered by Ar. In this case, when suitable amounts of Xe and Kr are added to Ar, internal stress of the Ta film is released, and pealing off this film can be prevented. Resistivity of the Ta film of α phase is about 20 μΩcm, and this Ta film can be used for the gate electrode. However, resistivity of the Ta film of β phase is about 180 μΩcm, and is not suitable for the gate electrode. When tantalum nitride having a crystal structure close to that of the α phase of Ta and having a thickness of about 10 to 50 nm is formed in advance as the base for the Ta film to form the Ta film of the α phase, the Ta film of α phase can be easily obtained.

The W film is formed by the sputtering method with W as a target. Further, the W film can be also formed by a thermal CVD method using tungsten hexafluoride ($WF_6$). In any case, it is necessary to reduce resistance to use this film as the gate electrode. It is desirable to set resistivity of the W film to be equal to or smaller than 20 μΩcm. When crystal grains of the W film are increased in size, resistivity of the W film can be reduced. However, when there are many impurity elements such as oxygen, etc. within the W film, crystallization is prevented and resistivity is increased. Accordingly, in the case of the sputtering method, a W-target of 99.9999% or 99.99% in purity is used, and the W film is formed by taking a sufficient care of not mixing impurities from a gaseous phase into the W film time when the film is to be formed. Thus, a resistivity of from 9 to 20 μΩcm can be realized.

In this embodiment, the first conductive film 308 is formed from Ta, and the second conductive film 309 is formed from W. However, the present invention is not limited to this case. Each of these conductive films may also be formed from an element selected from Ta, W, Ti, Mo, Al and Cu, or an alloy material or a compound material having these elements as principal components. Further, a semiconductor film represented by a polysilicon film doped with an impurity element such as phosphorus may also be used. Examples of combinations other than those shown in this embodiment include: a combination in which the first conductive film 308 is formed from tantalum nitride (TaN), and the second conductive film 309 is formed from W; a combination in which the first conductive film 308 is formed from tantalum nitride (TaN), and the second conductive film 309 is formed from Al; and a combination in which the first conductive film 308 is formed from tantalum nitride (TaN), and the second conductive film 309 is formed from Cu. (FIG. 13A)

Next, a mask 310 is formed from a resist, and first etching processing for forming an electrode and wiring is performed.

In this embodiment, an ICP (Inductively Coupled Plasma) etching method is used, and $CF_4$ and $Cl_2$ are mixed with a gas for etching. RF (13.56 MHz) power of 500 W is applied to the electrode of coil type at a pressure of 1 Pa so that plasma is generated. RF (13.56 MHz) of 100 W power is also applied to a substrate side (sample stage), and a substantially negative self bias voltage is applied. When $CF_4$ and $Cl_2$ are mixed, the W film and the Ta film are etched to the same extent.

Under the above etching condition, end portions of a first conductive layer and a second conductive layer are formed into a tapered shape by effects of the bias voltage applied to the substrate side by making the shape of the mask formed from the resist into an appropriate shape. The angle of a taper portion is set to from 15° to 45°. It is preferable to increase an etching time by a ratio of about 10 to 20% so as to perform the etching without leaving the residue on the gate insulating film. Since a selection ratio of a silicon oxynitride film to the W film ranges from 2 to 4 (typically 3), an exposed face of the silicon oxynitride film is etched by about 20 to 50 nm by over-etching processing. Thus, conductive layers 311 to 314 of a first shape (first conductive layers 311*a* to 314*a* and second conductive layers 311*b* to 314*b*) formed of the first and second conductive layers are formed by the first etching processing. A region that is not covered with the conductive layers 311 to 314 of the first shape is etched by about 20 to 50 nm in the gate insulating film 307, so that a thinned region is formed. Further, the surface of mask 310 also is etched by the above etching.

Then, an impurity element for giving an n-type conductivity is added by performing first doping processing. A doping method may be either an ion doping method or an ion implantation method. The ion doping method is carried out under the condition that a dose is set to from $1\times10^{13}$ to $5\times10^{14}$ atoms/cm$^2$, and an acceleration voltage is set to from 60 to 100 keV. An element belonging to group 15, typically, phosphorus (P) or arsenic (As) is used as the impurity element for giving the n-type conductivity. However, phosphorus (P) is used here. In this case, the conductive layers 311 to 314 serve as masks with respect to the impurity element for giving the n-type conductivity, and first impurity regions 317 to 320 are formed in a self-aligning manner. The impurity element for giving the n-type conductivity is added to the first impurity regions 317 to 320 in a concentration range from $1\times10^{20}$ to $1\times10^{21}$ atoms/cm$^3$ (FIG. 13B).

Second etching processing is next performed without removing the resist mask 310 as shown in FIG. 13C. A W film is etched selectively by using $CF_4$, $Cl_2$ and $O_2$ as the etching gas. The conductive layers 325 to 328 of a second shape (first conductive layers 325*a* to 328*a* and second conductive layers 325*b* to 328*b*) are formed by the second etching processing. A region of the gate insulating film 307, which is not covered with the conductive layers 325 to 328 of the second shape, is further etched by about 20 to 50 nm so that a thinned region is formed.

An etching reaction in the etching of the W film or the Ta film using the mixed gas of $CF_4$ and $Cl_2$ can be assumed from the vapor pressure of a radical or ion species generated and a reaction product. When the vapor pressures of a fluoride and a chloride of W and Ta are compared, the vapor pressure of $WF_6$ as a fluoride of W is extremely high, and vapor pressures of other $WCl_5$, $TaF_5$ and $TaCl_5$ are approximately equal to each other. Accordingly, both the W film and the Ta film are etched using the mixed gas of $CF_4$ and $Cl_2$. However, when a suitable amount of $O_2$ is added to this mixed gas, $CF_4$ and $O_2$ react and become CO and F so that a large amount of F-radicals or F-ions is generated. As a result, the etching speed of the W film whose fluoride has a high vapor pressure is increased. In contrast to this, the increase in etching speed is relatively small for the Ta film when F is increased. Since Ta is easily oxidized in comparison with W, the surface of the Ta film is oxidized by adding $O_2$. Since no oxide of Ta reacts with fluorine or chloride, the etching speed of the Ta film is further reduced. Accordingly, it is possible to make a difference in etching speed between the W film and the Ta film so that the etching speed of the W film can be set to be higher than that of the Ta film.

Figure 14A:
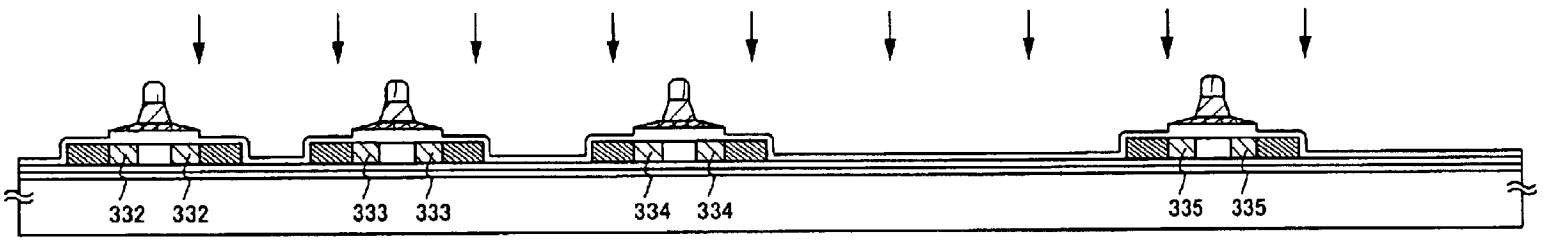
FIGS. 14A–14C are diagrams illustrating a method for fabricating the light emitting device according to the invention.

As shown in FIG. 14A, second doping processing is then performed. In this case, an impurity element for giving the n-type conductivity is doped in a smaller dose than in the first doping processing and at a high acceleration voltage by reducing a dose lower than that in the first doping processing. For example, the acceleration voltage is set to from 70 to 120 keV, and the dose is set to $1\times10^{13}$ atoms/cm$^2$. Thus, a new impurity region is formed inside the first impurity region formed in the island-like semiconductor layer in FIG. 13B. In the doping, the conductive layers 325 to 328 of the second shape are used as masks with respect to the impurity element, and the doping is performed such that the impurity element is also added to regions underside the first conductive layers 325*a* to 328*a*. Thus, third impurity regions 332 to 335 are formed. The third impurity regions 332 to 335 contain phosphorus (P) with a gentle concentration gradient that conforms with the thickness gradient in the tapered portions of the first conductive layers 325*a* to 328*a*. In the semiconductor layers that overlap the tapered portions of the first conductive layers 325*a* to 328*a*, the impurity concentration is slightly lower around the center than at the edges of the tapered portions of the first conductive layers 325*a* to 328*a*. However, the difference is very slight and almost the same impurity concentration is kept throughout the semiconductor layers.

Figure 14B:
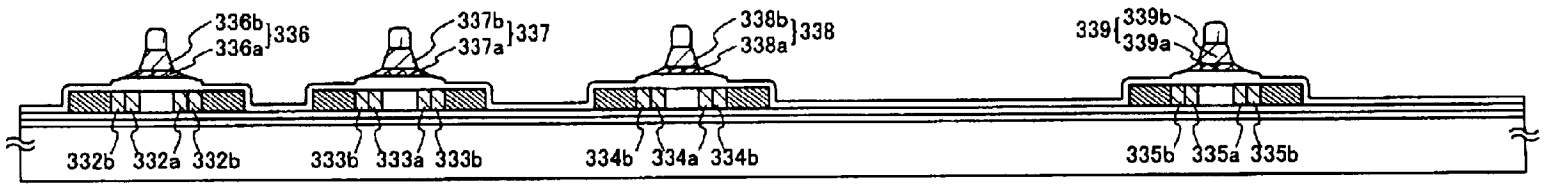

Third etching treatment is then carried out as shown in FIG. 14B. $CHF_6$ is used as etching gas, and reactive ion etching (RIE) is employed. Through the third etching treatment, the tapered portions of the first conductive layers 325*a* to 328*a* are partially etched to reduce the regions where the first conductive layers overlap the semiconductor layers. Thus formed are third shape conductive layers 336 to 339 (first conductive layers 336*a* to 339*a* and second conductive layers 336*b* to 339*b*). At this point, regions of the gate insulating film 307 that are not covered with the third shape conductive layers 336 to 339 are further etched and thinned by about 20 to 50 nm.

Third impurity regions 332 to 335 are formed through the third etching treatment. The third impurity regions 332*a* to 335*a* that overlap the first conductive layers 336*a* to 339*a*, respectively, and second impurity regions 332*b* to 335*b* each formed between a first impurity region and a third impurity region.

Figure 14C:
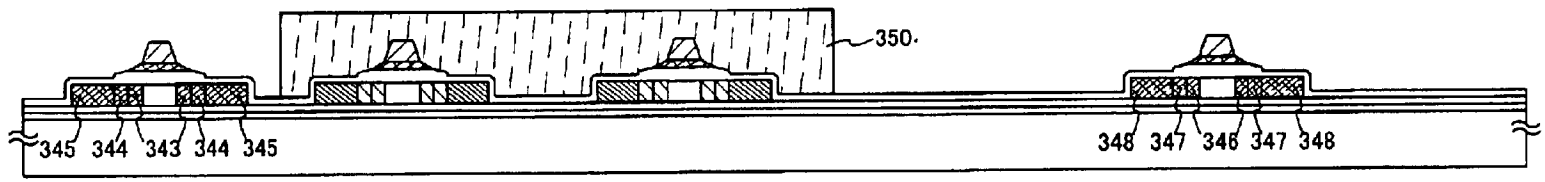

As shown in FIG. 14C, fourth impurity regions 343 to 348 having the opposite conductivity type to the first conductivity type are formed in the island-like semiconductor layers 303 and 306 for forming p-channel type TFTs. The third shape conductive layers 336*b* and 339*b* are used as masks against the impurity element and impurity regions are formed in a self-aligning manner. At this point, the island-like semiconductor layers 304 and 305 for forming n-channel type TFTs are entirely covered with a resist mask 350. The impurity regions 343 to 348 have already been doped with phosphorus in different concentrations. The impurity regions 343 to 348 are doped with diborane ($B_2H_6$) through ion doping and its impurity concentrations are set to form $2\times10^{20}$ to $2\times10^{21}$ atoms/cm$^3$ in the respective impurity regions.

Through the steps above, the impurity regions are formed in the respective island-like semiconductor layers. The third shape conductive layers 336 to 339 overlapping the island-like semiconductor layers function as gate electrodes.

After resist mask 350 is removed, a step of activating the impurity elements added to the island-like semiconductor layers is performed to control the conductivity type. This process is performed by a thermal annealing method using a furnace for furnace annealing. Further, a laser annealing method or a rapid thermal annealing method (RTA method) can be applied. In the thermal annealing method, this process is performed at a temperature of from 400 to 700° C., typically from 500 to 600° C. within a nitrogen atmosphere in which oxygen concentration is equal to or smaller than 1 ppm and is preferably equal to or smaller than 0.1 ppm. In this embodiment, heat treatment is performed for four hours at a temperature of 500° C. When a wiring material used in the third shape conductive layers 336 to 339 is weak against heat, it is preferable to perform activation after an interlayer insulating film (having silicon as a principal component) is formed in order to protect wiring, etc.

When the laser annealing method is employed, the laser used in the crystallization can be used. When activation is performed, the moving speed is set as well as the crystallization processing, and the energy density of about 0.01 to 100 $MW/cm^2$ (preferably 0.01 to 10 $MW/cm^2$) is required.

Further, the heat treatment is performed for 1 to 12 hours at a temperature of from 300 to 450° C. within an atmosphere including 3 to 100% of hydrogen so that the island-like semiconductor layer is hydrogenerated. This step is to terminate a dangling bond of the semiconductor layer by hydrogen thermally excited. Plasma hydrogenation (using hydrogen excited by plasma) may also be performed as another measure for hydrogenation.

Figures 15A, 15B:
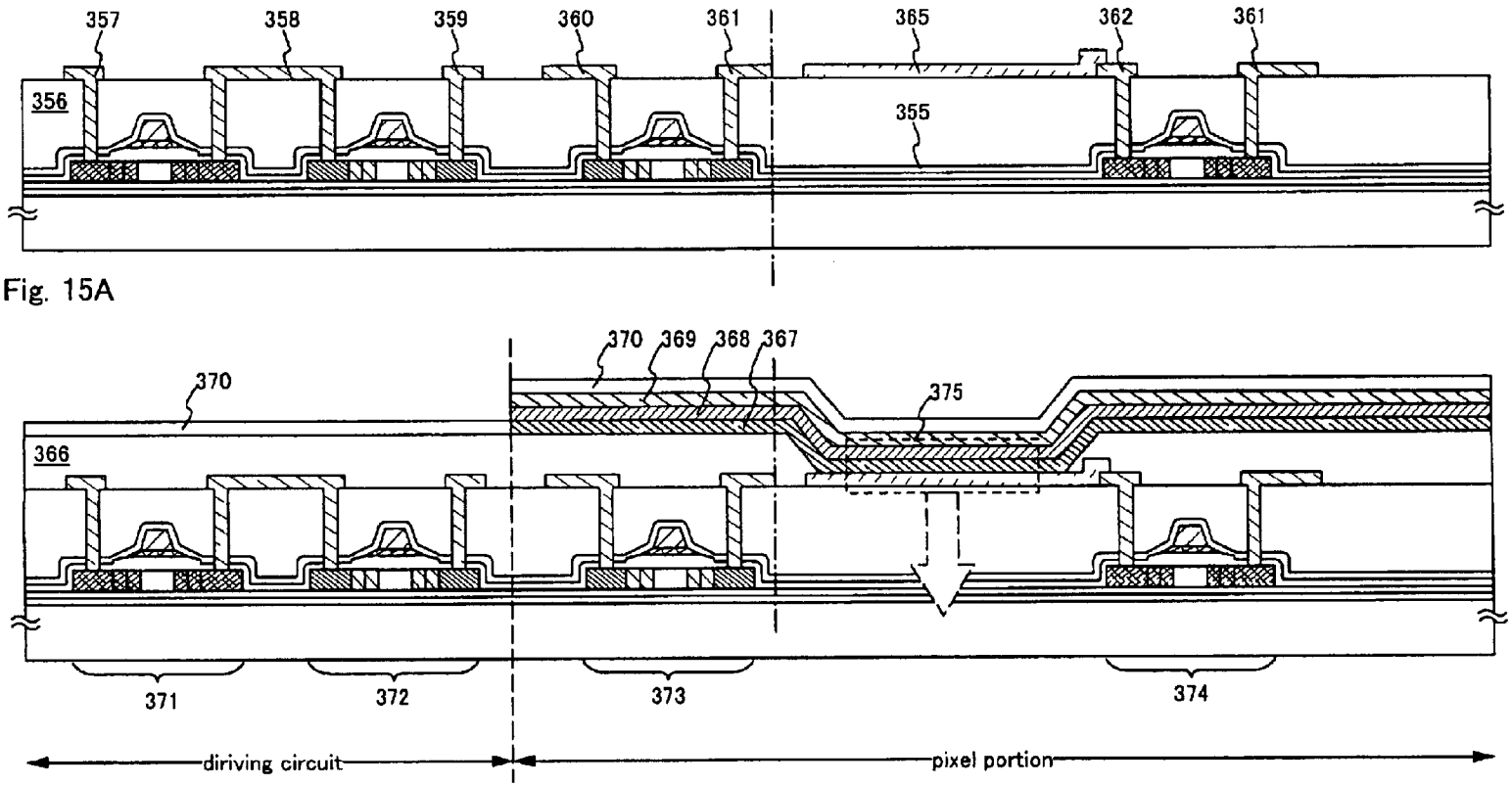
FIGS. 15A and 15B are diagrams illustrating a method for fabricating the light emitting device according to the invention.

Next, as shown in FIG. 15A, a first interlayer insulating film 355 is formed from a silicon oxynitride film with a thickness of 100 to 200 nm. The second interlayer insulating film 356 from an organic insulating material is formed on the first interlayer insulating film. Thereafter, contact holes are formed through the first interlayer insulating film 355, the second interlayer insulating film 356 and the gate insulating film 307, and connecting wirings 357 to 362 are patterned and formed. Note that reference numeral 362 is a power supply wiring and reference numeral 360 is a signal wiring.

A film having an organic resin as a material is used as the second interlayer insulating film 356. Polyimide, polyamide, acrylic, BCB (benzocyclobutene), etc. can be used as this organic resin. In particular, since the second interlayer insulating film 356 is provided mainly for planarization, acrylic excellent in leveling the film is preferable. In this embodiment, an acrylic film having a thickness that can sufficiently level a level difference caused by the TFT is formed. The film thickness thereof is preferably set to from 1 to 5 μm (is further preferably set to from 2 to 4 μm).

In the formation of the contact holes, contact holes reaching n-type impurity regions 318 and 319 or p-type impurity regions 345 and 348, a contact hole (not illustrated) reaching capacitive wiring (not illustrated) are formed respectively.

Further, a laminate film of a three-layer structure is patterned in a desired shape and is used as connecting wirings 357 to 362 and 380. In this three-layer structure, a Ti film with a thickness of 100 nm, an aluminum film containing Ti with a thickness of 300 nm, and a Ti film with a thickness of 150 nm are continuously formed by the sputtering method. Of course, another conductive film may also be used.

The pixel electrode 365 connected to the connecting wiring (connecting wiring) 362 is formed by patterning.

In this embodiment, an ITO film of 110 nm in thickness is formed as a pixel electrode 365, and is patterned. Contact is made by arranging the pixel electrode 365 such that this pixel electrode 365 comes in contact with the connecting electrode 362 and is overlapped with this connecting wiring 362. Further, a transparent conductive film provided by mixing 2 to 20% of zinc oxide (ZnO) with indium oxide may also be used. This pixel electrode 365 becomes an anode of the OLED element (FIG. 15A).

As shown in FIG. 15B, an insulating film (a silicon oxide film in this embodiment) containing silicon and having a thickness of 500 nm is next formed. A third interlayer insulating film 366 functions as a bank is formed in which an opening is formed in a position corresponding to the pixel electrode 365. When the opening is formed, a side wall of the opening can easily be tapered by using the wet etching method. When the side wall of the opening is not gentle enough, deterioration of an organic light emitting layer caused by a level difference becomes a notable problem.

Next, an organic light emitting layer 367 and a cathode (MgAg electrode) 368 are continuously formed by using the vacuum evaporation method without exposing to the atmosphere. The organic light emitting layer 367 has a thickness of from 80 to 200 nm (typically from 100 to 120 nm), and the cathode 368 has a thickness of from 180 to 300 nm (typically from 200 to 250 nm).

In this process, the organic light emitting layer is sequentially formed with respect to a pixel corresponding to red, a pixel corresponding to green and a pixel corresponding to blue. In this case, since the organic light emitting layer has an insufficient resistance against a solution, the organic light emitting layer must be formed separately for each color instead of using a photolithography technique. Therefore, it is preferable to cover a portion except for desired pixels using a metal mask so that the organic light emitting layer is formed selectively only in a required portion.

Namely, a mask for covering all portions except for the pixel corresponding to red is first set, and the organic light emitting layer for emitting red light are selectively formed by using this mask. Next, a mask for covering all portions except for the pixel corresponding to green is set, and the organic light emitting layer for emitting green light are selectively formed by using this mask. Next, a mask for covering all portions except for the pixel corresponding to blue is similarly set, and the organic light emitting layer for emitting blue light are selectively formed by using this mask. Here, different masks are used, but instead the same single mask may be used repeatedly.

Here, a system for forming three kinds of OLED element corresponding to RGB is used. However, a system in which an OLED element for emitting white light and a color filter are combined, a system in which the OLED element for emitting blue or blue green light is combined with a fluorescent substance (a fluorescent color converting medium: CCM), a system for overlapping the OLED elements respectively corresponding to R, G, and B with the cathodes (opposite electrodes) by utilizing a transparent electrode, etc. may be used.

A known material can be used as the organic light emitting layer 367. An organic material is preferably used as the known material in consideration of a driving voltage. For example, a four-layer structure consisting of a hole injection layer, a hole transportation layer, a light emitting layer and an electron injection layer is preferably used for the organic light emitting layer.

Next, the cathode 368 is formed. This embodiment uses MgAg for the cathode 368 but it is not limited thereto. Other known materials may be used for the cathode 368.

The overlapping portion, which is comprised of the pixel electrode 365, the organic light emitting layer 367 and the cathode 368, corresponds to OLED 375.

Next, the protective electrode 369 is formed by an evaporation method. The protective electrode 369 may be formed in succession forming the cathode 368 without exposing the device to the atmosphere. The protective electrode 369 has an effect on protect the organic light emitting layer 367 from moisture and oxygen.

The protective electrode 369 also prevents degradation of the cathode 368. A typical material of the protective electrode is a metal film mainly containing aluminum. Other material may of course be used. Since the organic light emitting layer 367 and the cathode 368 are extremely weak against moisture, the organic light emitting layer 367, the cathode 368, and the protective electrode 369 are desirably formed in succession without exposing them to the atmosphere. It is preferable to protect the organic light emitting layer from the outside atmosphere.

Lastly, a passivation film 370 is formed from a silicon nitride film with a thickness of 300 nm. The passivation film 370 protects the organic compound layer 367 from moisture and the like, thereby further enhancing the reliability of the OLED. However, the passivation film 370 may not necessarily be formed.

A light emitting device structured as shown in FIG. 15B is thus completed. Reference symbol 371 denotes p-channel TFT of the driving circuit, 372, n-channel TFT of driving circuit, 373, the transistor Tr4, and 374, the transistor Tr2.

The light emitting device of this embodiment exhibits very high reliability and improved operation characteristics owing to placing optimally structured TFTs in not only the pixel portion but also in the driving circuits. In the crystallization step, the film may be doped with a metal catalyst such as Ni to enhance the crystallinity. By enhancing the crystallinity, the drive frequency of the signal line driving circuit can be set to 10 MHz or higher.

In practice, the device reaching the state of FIG. 15B is packaged (enclosed) using a protective film that is highly airtight and allows little gas to transmit (such as a laminate film and a UV-curable resin film) or a light-transmissive seal, so as to further avoid exposure to the outside atmosphere. A space inside the seal may be set to an inert atmosphere or a hygroscopic substance (barium oxide, for example) may be placed there to improve the reliability of the OLED.

After securing the airtightness through packaging or other processing, a connector is attached for connecting an external signal terminal with a terminal led out from the elements or circuits formed on the substrate.

By following the process shown in this embodiment, the number of photo masks needed in manufacturing a light emitting device can be reduced. As a result, the process is cut short to reduce the manufacture cost and improve the yield.

This embodiment can be performed by being freely combined with Embodiments 1 through 5.

Embodiment 7

In this embodiment, an external light emitting quantum efficiency can be remarkably improved by using an organic light emitting material by which phosphorescence from a triplet excitation can be employed for emitting a light. As a result, the power consumption of light emitting element can be reduced, the lifetime of light emitting element can be elongated and the weight of light emitting element can be lightened.

The following is a report where the external light emitting quantum efficiency is improved by using the triplet excitation (T. Tsutsui, C. Adachi, S. Saito, Photochemical processes in Organized Molecular Systems, ed. K. Honda, (Elsevier Sci. Pub., Tokyo, 1991) p. 437).

The molecular formula of an organic light emitting material (coumarin pigment) reported by the above article is represented as follows.

Chemical formula 1

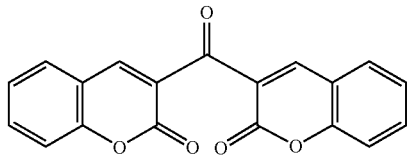

(M. A. Baldo, D. F. O'Brien, Y. You, A. Shoustikov, S. Sibley, M. E. Thompson, S. R. Forrest, Nature 395 (1998) p.151)

The molecular formula of an organic light emitting material (Pt complex) reported by the above article is represented as follows.

Chemical formula 2

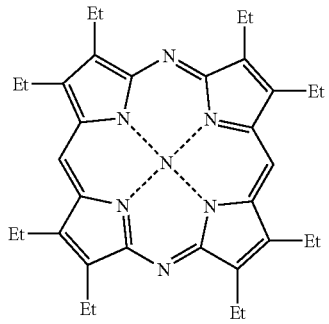

(M. A. Baldo, S. Lamansky, P. E. Burrows, M. E. Thompson, S. R. Forrest, Appl. Phys. Lett., 75 (1999) p.4.)
(T. Tsutsui, M.-J. Yang, M. Yahiro, K. Nakamura, T. Watanabe, T. Tsuji, Y. Fukuda, T. Wakimoto, S. Mayaguchi, Jpn, Appl. Phys., 38 (12B) (1999) L1502)

The molecular formula of an organic light emitting material (Ir complex) reported by the above article is represented as follows.

Chemical formula 3

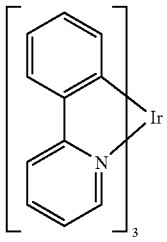

As described above, if phosphorescence from a triplet excitation can be put to practical use, it can realize the external light emitting quantum efficiency three to four times as high as that in the case of using fluorescence from a singlet excitation in principle.

The structure according to this embodiment can be freely implemented in combination of any structures of the Embodiments 1 to 6.

Embodiment 8

Figure 16:
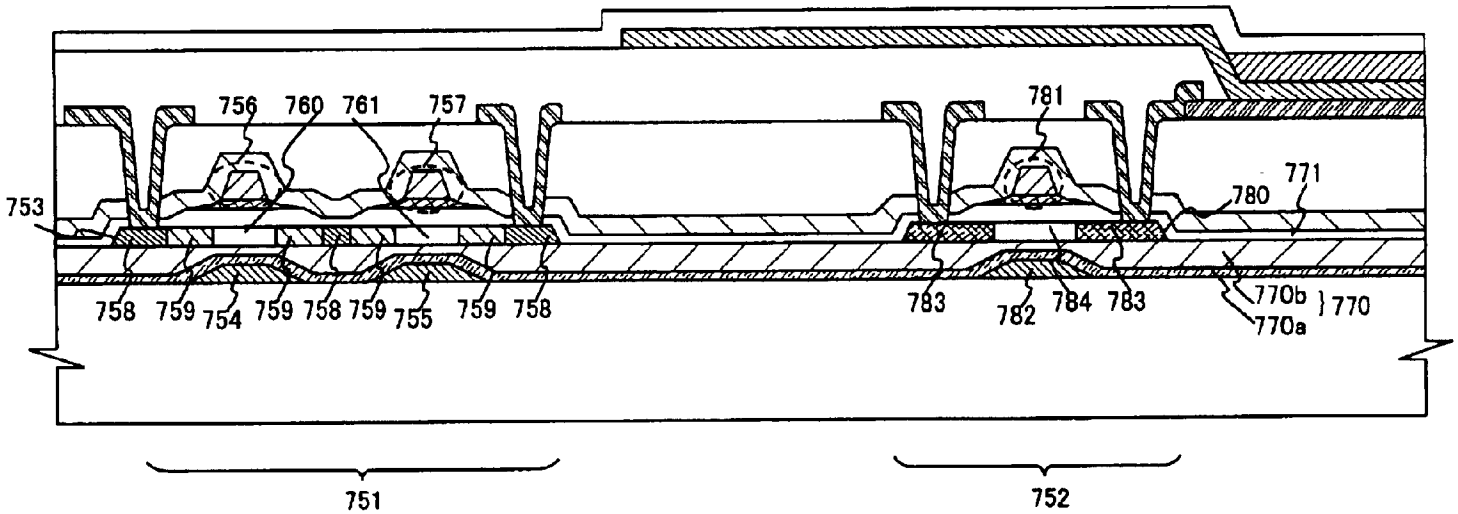
FIG. 16 is a sectional view showing the light emitting device according to the invention.

In this embodiment, constitution of a pixel of a light emitting device being one of the semiconductor devices of the present invention is described below. FIG. 16 shows a cross-sectional view of a pixel built in a light emitting device according to this embodiment. For simplifying the related illustration, only n-channel type TFTs having pixels and p-channel type TFTs controlling current fed to pixel electrodes are illustrated, other TFTs can be manufactured by referring to the constitutions shown in FIG. 16.

Referring to FIG. 16, reference numeral 751 designates an n-channel type TFT, while Reference numeral 752 denotes a p-channel type TFT. The n-channel type TFT 751 comprises a semiconductor film 753, a first insulating film 770, a pair of first electrodes 754 and 755, a second insulating film 771, and a pair of second electrodes 756 and 757. The semiconductor film 753 comprises a one-conductivity-type impurity region 758 having a first impurity concentration, a one-conductivity-type impurity region 759 having a second impurity concentration, and a pair of channel-formation regions 760 and 761.

In this embodiment, the first insulating film 770 consists of a pair of laminated insulating films 770*a* and 770*b*. Alternatively, it is also practicable to provide the first insulating film 770 composed of a single-layer insulating film or an insulating film comprising three or more laminated layers.

A pair of the channel-formation regions 760 and 761 oppose a pair of the first electrodes 754 and 755 through the first insulating film 770 arranged therebetween. The other channel-formation regions 760 and 761 are also superposed on a pair of the second electrodes 756 and 757 by way of sandwiching the second insulating film 771 in-between.

The p-channel type TFT 752 comprises a semiconductor film 780, a first insulating film 770, a first electrode 782, a second insulating film 771, and a second electrode 781. The semiconductor film 780 comprises a one-conductivity-type impurity region 783 having a third impurity concentration, and a channel-formation region 784.

The channel-formation region 784 and the first electrode 782 oppose each other through the first insulating film 770. Further, the channel-formation region 784 and the second electrode 781 also oppose each other through the second insulating film 771 arranged therebetween.

In this embodiment, although not shown in FIG. 16, a pair of the first electrodes 754 and 755 and a pair of the second electrodes 756 and 757 are electrically connected to each other. It should be noted that the scope of the present invention is not solely limited to the above connecting relationship, but it is also practicable to realize such a constitution in which the first electrodes 754 and 755 are electrically disconnected from the second electrodes 756 and 757 and are applied with a predetermined voltage. Alternatively, it is also possible to realize such a constitution in which the first electrode 782 is electrically disconnected from the second electrode 781 and is applied with a predetermined voltage.

Compared to the case of utilizing only one electrode, by applying a predetermined voltage to the first electrode 782, potential variation of the threshold value can be prevented from occurring, and yet, OFF-current can be suppressed. Further, by applying the same voltage to the first and second electrodes, in the same way as in the case of substantially reducing thickness of the semiconductor film, depletion layer quickly spreads, thus making it possible to minimize sub-threshold coefficient and further improve the field-effect mobility. Accordingly, compared to the case of utilizing one electrode, it is possible to increase value of an ON current. Further, by employing the above-referred TFTs based on the above-described constitutions, it is possible to lower the drive voltage. Further, since it is possible to increase the value of an ON current, it is possible to contract the actual size, in particular, the channel width, of the TFTs, it is possible to increase the integration density.

Embodiment 8 can be performed by being freely combined with anyone of Embodiments 1 to 7.

Embodiment 9

Figure 17:
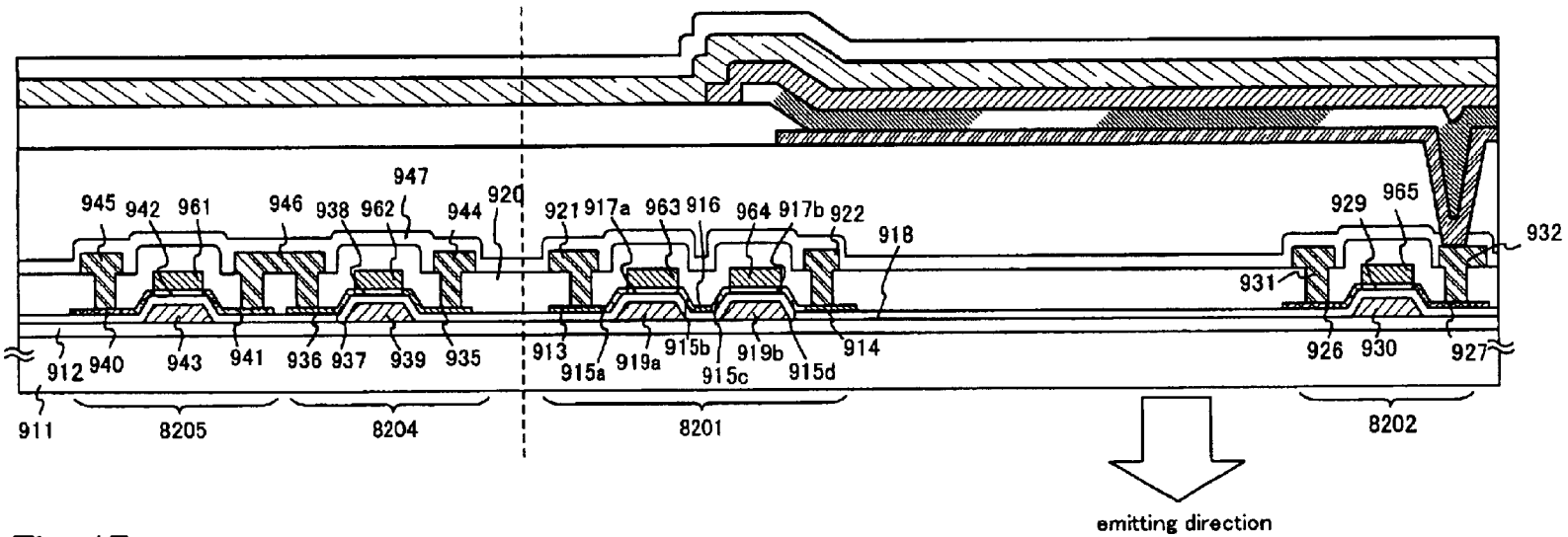
FIG. 17 is a sectional view showing the light emitting device according to the invention.

In this embodiment, constitution of a pixel of a light emitting device being one of the semiconductor devices of the present invention is described below. FIG. 17 shows a cross-sectional view of a pixel built in a light emitting device according to this embodiment. For simplifying the related illustration, only n-channel type TFTs having pixels and p-channel type TFTs controlling current fed to pixel electrodes are illustrated, other TFTs also can be manufactured by referring to the constitutions shown in FIG. 17.

Reference numeral 911 denotes a substrate in FIG. 17, and reference numeral 912 denotes an insulating film which becomes a base (hereafter referred to as a base film). A light transmitting substrate, typically a glass substrate, a quartz substrate, a glass ceramic substrate, or a crystalline glass substrate can be used as the substrate 911. However, the substrate used must be one able to withstand the highest process temperature during the manufacturing processes.

Reference numeral 8201 denotes an n-channel type TFT, while 8202 denotes a p-channel type TFT. The n-channel type TFT 8201 comprises a source region 913, a drain region 914, a pair of LDD regions 915*a*–915*d*, a separating region 916 and active layers have a pair of channel formation regions 917*a* and 917*b* therein, a gate insulting film 918, a pair of gate electrodes 919*a* and 919*b*, a first interlayer insulting film 920 and a signal wiring 921, a connection wiring 922. Note that the gate insulating film 918 and the first interlayer insulating film 920 may be common among all TFTs on the substrate, or may differ depending upon the circuit or the element.

Further, the n-channel type TFT 8201 shown in FIG. 17 is electrically connected to the gate electrodes 919*a* and 919*b*, becoming namely a double gate structure. Not only the double gate structure, but also a multi gate structure (a structure containing an active layer having two or more channel forming regions connected in series) such as a triple gate structure, may of course also be used.

The multi-gate structure is extremely effective in reducing the off current, and provided that the off current of the Tr5 is sufficiently lowered, a storage capacitor connected to the gate electrode of the p-channel type TFT 8202 can be have its capacitance reduced to the minimum necessary. Namely, the surface area of the storage capacitor can be made smaller, and therefore using the multi-gate structure is also effective in expanding the effective light emitting surface area of the organic light emitting elements.

In addition, the LDD regions 915*a* to 915*d* are formed so as not to overlap the gate electrodes 919*a* and 919*b* through the gate insulating film 918 in the n-channel type TFT 8201. This type of structure is extremely effective in reducing the off current. Furthermore, the length (width) of the LDD regions 915*a* to 915*d* may be set from 0.5 to 3.5 μm, typically between 2.0 and 2.5 μm. Further, when using a multi-gate structure having two or more gate electrodes, the separating region 916 (a region to which the same impurity element, at the same concentration, as that added to the source region or the drain region, is added) is effective in reducing the off current.

Next, the p-channel type 8202 is formed having an active layer containing a source region 926, a drain region 927, and a channel region 929; the gate insulating film 918; a gate electrode 930, the first interlayer insulating film 920; a connecting wiring 931; and a connecting wiring 932. The p-channel type 8202 is a p-channel TFT in Embodiment 9.

Incidentally, the gate electrode 930 is a single structure; the gate electrode 930 may be a multi-structure.

The structures of the TFTs formed within the pixel are explained above, but a driver circuit is also formed simultaneously at this point. A CMOS circuit, which becomes a basic unit for forming the driver circuit, is shown in FIG. 17.

A TFT having a structure in which hot carrier injection is reduced without an excessive drop in the operating speed is used as an n-channel TFT 8204 of the CMOS circuit in FIG. 17. Note that the term driver circuit indicates a source signal line driver circuit and a gate signal line driver circuit here. It is also possible to form other logic circuit (such as a level shifter, an A/D converter, and a signal division circuit).

An active layer of the n-channel TFT 8204 of the CMOS circuit contains a source region 935, a drain region 936, an LDD region 937, and a channel region 938. The LDD region 937 overlaps with a gate electrode 939 through the gate insulating film 918.

Formation of the LDD region 937 on only the drain region 936 side is so as not to have dropped the operating speed. Further, it is not necessary to be very concerned about the off current with the n-channel TFT 8204, and it is good to place more importance on the operating speed. Thus, it is desirable that the LDD region 937 is made to completely overlap the gate electrode to decrease a resistance component to a minimum. It is therefore preferable to eliminate so-called offset.

Furthermore, there is almost no need to be concerned with degradation of a p-channel TFT 8205 of the CMOS circuit, due to hot carrier injection, and therefore no LDD region need be formed in particular. Its active layer therefore contains a source region 940, a drain region 941, and a channel region 942, and a gate insulating film 918 and a gate electrode 943 are formed on the active layer. It is also possible, of course, to take measures against hot carrier injection by forming an LDD region similar to that of the n-channel TFT 8204.

The reference numerals 961 to 965 are a mask to form the channel region 942, 938, 917*a*, 917*b*, and 929.

Further, the n-channel TFT 8204 and the p-channel TFT 8205 have source wirings 944 and 945, respectively, on their source regions, through the first interlayer insulating film 920. In addition, the drain regions of the n-channel TFT 8204 and the p-channel TFT 8205 are mutually connected electrically by a drain wiring 946.

Note that the structure of this embodiment can be performed by freely combining with Embodiments 1 to 7.

Embodiment 10

The following description on this embodiment refers to the constitution of a pixel utilizing a cathode as a pixel electrode.

Figure 18:
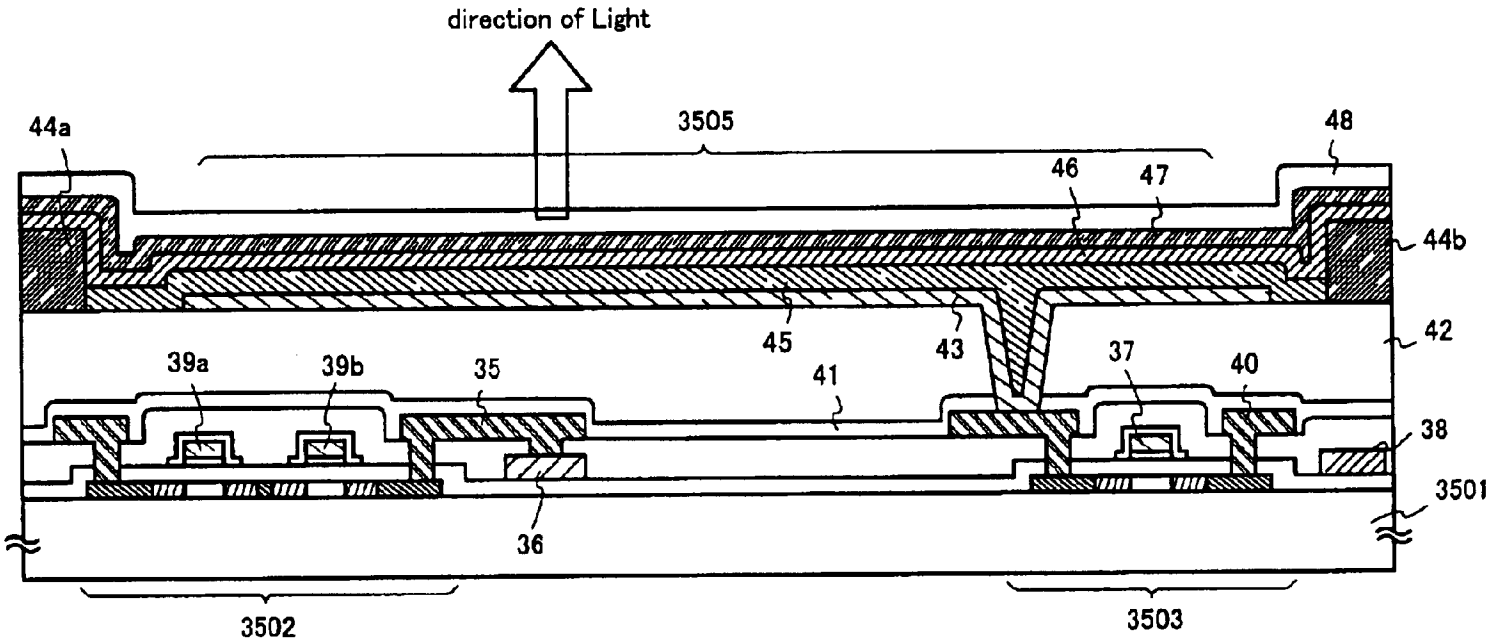
FIG. 18 is a sectional view showing the light emitting device according to the invention.

FIG. 18 exemplifies a cross-sectional view of a pixel according to this embodiment. In FIG. 18, an n-channel type TFT 3502 manufactured on a substrate 3501 is manufactured by applying a conventional method. In this embodiment, an n-channel type TFT 3502 based on the double-gate construction is used. However, it is also practicable to employ a single-gate construction, or a triple-gate construction, or a multiple-gate construction incorporating more than three of gate electrodes. To simplify the illustration, only n-channel type TFTs having pixels and p-channel type TFTs controlling current fed to pixel electrodes are illustrated, other TFTs can also be manufactured by referring to the structures shown in FIG. 18.

A p-channel type TFT 3503 can be manufactured by applying a known method. A wiring designated by reference numeral 38 corresponds to a scanning line for electrically linking a gate electrode 39*a* of the above p-channel type TFT 3503 with the other gate electrode 39*b* thereof.

In this embodiment shown in FIG. 18, the above p-channel type TFT is exemplified as having a single-gate construction. However, the p-channel type TFT may have a multiple-gate construction in which a plurality of TFTs are connected in series with each other. Further, such a construction may also be introduced, which substantially splits a channel-formation region into plural parts connecting a plurality of TFTs in parallel with each other, thereby enabling them to radiate heat with higher efficiency. This construction is quite effective to cope with thermal degradation of the TFTs.

A first inter-layer insulating film 41 is formed on the n-channel type TFT 3502 and p-channel type 3503. Further, a second inter-layer insulating film 42 made of resinous insulating film is formed on the first inter-layer insulating film 41. It is extremely important to fully level off steps produced by provision of TFTs by utilizing the second inter-layer insulating film 42. This is because, since organic light emitting layers to be formed later on are extremely thin, since presence of such steps may cause faulty light emission to occur. Taking this into consideration, before forming the pixel electrode, it is desired that the above-referred steps be leveled off as much as possible so that the organic light emitting layers can be formed on a fully leveled surface.

Reference numeral 43 in FIG. 18 designates a pixel electrode, i.e., a cathode electrode provided for the light emitting element, composed of a highly reflective electrically conductive film. The pixel electrode 43 is electrically connected to the drain region of the p-channel type TFT 3503. For the pixel electrode 43, it is desired to use an electrically conductive film having a low resistance value such as an aluminum alloy film, a copper alloy film, or a silver alloy film, or a laminate of these alloy films. It is of course practicable to utilize such a construction that employs a laminate comprising the above-referred alloy films combined with other kinds of metallic films bearing electrical conductivity.

FIG. 18 exemplifies a light emitting layer 45 formed inside of a groove (this corresponds to a pixel) produced between a pair of banks 44*a* and 44*b* which are made from resinous insulating films. Although not shown in FIG. 18, it is also practicable to separately form a plurality of light emitting layers respectively corresponding to three colors of red, green, and blue. Organic light emitting material such as π-conjugate polymer material is utilized to compose the light emitting layers. Typically, available polymer materials include the following: polyparaphenylene vinyl (PPV), polyvinyl carbazol (PVK), and polyfluorene, for example.

There are a wide variety of organic light emitting materials comprising the above-referred PPV. For example, such materials cited in the following publications may be used: H. Shenk, H. Becker, O. Gelsen, E. Kluge, W. Spreitzer "Polymers for Light Emitting Diodes", Euro Display, Proceedings, 1999, pp. 33–37, and such material, set forth in the JP-10-92576 A.

As a specific example of the above-referred light emitting layers, there may be used cyano-polyphenylene-vinylene for composing a layer for emitting red light; polyphenylene-vinylene for composing a layer for emitting green light; and polyphnylene or polyalkylphenylene for composing a layer for emitting blue light. It is suggested that the thickness of an individual light emitting layer shall be defined in a range of from 30 nm to 150 nm, preferably in a range of from 40 nm to 100 nm.

The above description, however, has solely referred to a typical example of organic light emitting materials available for composing light emitting layers, and thus, applicable organic light emitting materials are not necessarily limited to those which are cited above. Thus, organic light emitting layers (layers for enabling light emission as well as movement of carriers therefor) freely combining light emitting layers, charge-transfer layers, and charge-injection layers with each other.

For example, this embodiment has exemplified such a case in which polymer materials are utilized for composing light emitting layers. However, it is also possible to utilize organic light emitting materials comprising low-molecular weight compound, for example. To compose a charge-transfer layer and a charge-injection layer, it is also possible to utilize inorganic materials such as silicon carbide for example. Conventionally known materials may be used as the organic materials and the inorganic materials.

In this embodiment, organic light emitting layers having a laminate structure are formed, in which a hole injection layer 46 made from polythiophene (PEDOT) or polyaniline (PAni) is formed on the light emitting layer 45. An anode electrode 47 composed of a transparent electrically conductive film is formed on the hole injection layer 46. In the pixel shown in FIG. 20, light generated by the light emitting layers 45 is radiant in the direction of the upper surface of the TFT. Because of this, the anode electrode 47 must be light-permeable. To form a transparent electrically conductive film, a compound comprising indium oxide and tin dioxide or a compound comprising indium oxide and zinc oxide may be utilized. However, since the transparent electrically conductive film is formed after completing formation of the light emitting layer 45 and the hole injection layer 46 both having poor heat-resisting property, it is desired that the anode electrode 47 be formed at a low temperature as possible.

Upon completion of the formation of the anode electrode 47, the light emitting element 3505 is completed. Here, the light emitting element 3505 is provided with the pixel electrode (cathode electrode) 43, the light emitting layers 45, the hole injection layer 46, and the anode electrode 47. Since the area of the pixel electrode 43 substantially coincides with the total area of the pixel, the entire pixel functions itself as a light emitting element. Accordingly, an extremely high light-emitting efficiency is attained in practical use, thereby making it possible to display an image with high luminance.

This embodiment further provides a second passivation film 48 on the anode electrode 47. It is desired that silicon nitride or silicon oxynitride be utilized for composing the second passivation film 48. The second passivation film 48 shields the light emitting element 3505 from the external in order to prevent unwanted degradation thereof caused by oxidation of the organic light emitting material and also prevent gas component from leaving the organic light emitting material. By virtue of the above arrangement, reliability of the light emitting device is enhanced furthermore.

As described above, the light emitting device of the present invention shown in FIG. 18 includes pixel portions each having the constitution as exemplified therein. In particular, the light emitting device utilizes the TFT 3502 with a sufficiently a low OFF current value and the TFT 3503 capable of fully withstanding injection of heated carriers. Because of these advantageous features, the light emitting device shown in FIG. 18 has enhanced reliability and can display clear image.

Incidentally, the structure of Embodiment 10 can be performed by freely combining with the structure of Embodiments 1 to 7.

Embodiment 11

The light emitting device using the light emitting element is of the self-emission type, and thus exhibits more excellent recognizability of the displayed image in a light place as compared to the liquid crystal display device. Furthermore, the light emitting device has a wider viewing angle. Accordingly, the light emitting device can be applied to a display portion in various electronic apparatuses.

Such electronic apparatuses using a light emitting device of the present invention include a video camera, a digital camera, a goggles-type display (head mount display), a navigation system, a sound reproduction device (a car audio equipment and an audio set), a lap-top computer, a game machine, a portable information terminal (a mobile computer, a mobile phone, a portable game machine, an electronic book, or the like), an image reproduction device including a recording medium (more specifically, an device which can reproduce a recording medium such as a digital versatile disc (DVD) and so forth, and includes a display for displaying the reproduced image), or the like. In particular, in the case of the portable information terminal, use of the light emitting device is preferable, since the portable information terminal that is likely to be viewed from a tilted direction is often required to have a wide viewing angle. FIG. 19 respectively shows various specific embodiments of such electronic apparatuses.

Figure 19A:
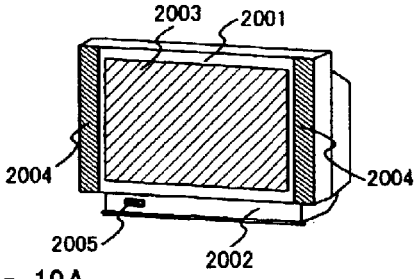
FIGS. 19A–19H are diagrams illustrating electronic apparatuses employing the light emitting device according to the invention.

FIG. 19A illustrates a display device which includes a casing 2001, a support table 2002, a display portion 2003, a speaker portion 2004, a video input terminal 2005 or the like. The present invention is applicable to the display portion 2003. The light emitting device is of the self-emission-type and therefore requires no backlight. Thus, the display portion thereof can have a thickness thinner than that of the liquid crystal display device. The organic light emitting display device is including the entire display device for displaying information, such as a personal computer, a receiver of TV broadcasting and an advertising display.

Figure 19B:
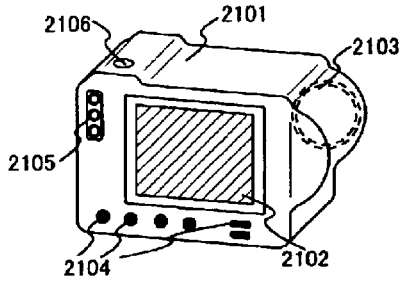

FIG. 19B illustrated a digital still camera which includes a main body 2101, a display portion 2102, an image receiving portion 2103, an operation key 2104, an external connection port 2105, a shutter 2106, or the like. The light emitting device in accordance with the present invention is used as the display portion 2102, thereby the digital still camera of the present invention completing.

Figure 19C:
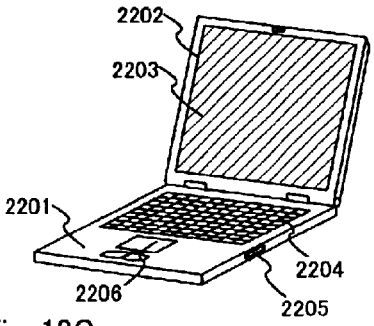

FIG. 19C illustrates a lap-top computer which includes a main body 2201, a casing 2202, a display portion 2203, a keyboard 2204, an external connection port 2205, a pointing mouse 2206, or the like. The light emitting device in accordance with the present invention is used as the display portion 2203, thereby the lap-top computer of the present invention completing.

Figure 19D:
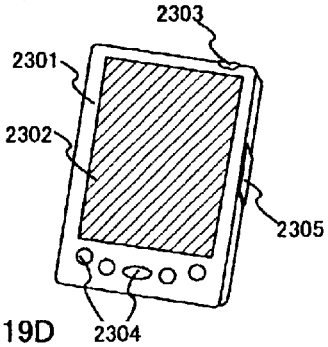

FIG. 19D illustrated a mobile computer which includes a main body 2301, a display portion 2302, a switch 2303, an operation key 2304, an infrared port 2305, or the like. The light emitting device in accordance with the present invention is used as the display portion 2302, thereby the mobile computer of the present invention completing.

Figure 19E:
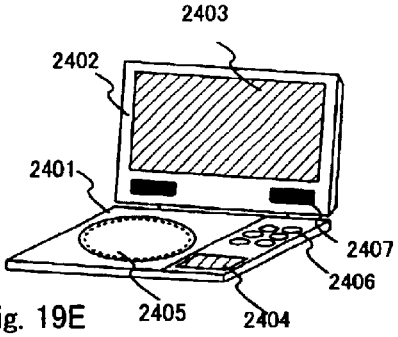

FIG. 19E illustrates a portable image reproduction device including a recording medium (more specifically, a DVD reproduction device), which includes a main body 2401, a casing 2402, a display portion A 2403, another display portion B 2404, a recording medium (DVD or the like) reading portion 2405, an operation key 2406, a speaker portion 2407 or the like. The display portion A 2403 is used mainly for displaying image information, while the display portion B 2404 is used mainly for displaying character information. The image reproduction device including a recording medium further includes a game machine or the like. The light emitting device in accordance with the present invention is used as these display portions A 2403 and B 2404, thereby the image reproduction device of the present invention completing.

Figure 19F:
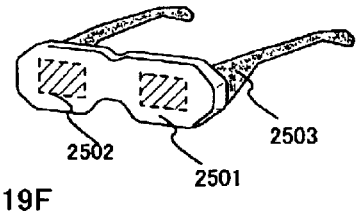

FIG. 19F illustrates a goggle type display (head mounted display) which includes a main body 2501, a display portion 2502, arm portion 2503 or the like. The light emitting device in accordance with the present invention is used as the display portion 2502, thereby the goggle type display of the present invention completing.

Figure 19G:
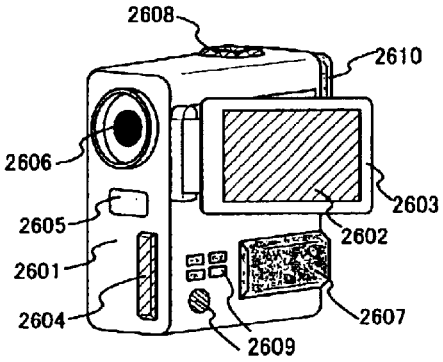

FIG. 19G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, an eyepiece 2610, or the like. The light emitting device in accordance with the present invention is used as the display portion 2602, thereby the video camera of the present invention completing.

Figure 19H:
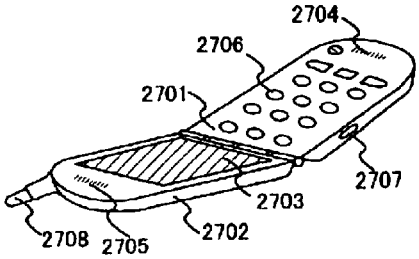

FIG. 19H illustrates a mobile phone which includes a main body 2701, a casing 2702, a display portion 2703, a sound input portion 2704, a sound output portion 2705, an operation key 2706, an external connecting port 2707, an antenna 2708, or the like. Note that the display portion 2703 can reduce power consumption of the mobile telephone by displaying white-colored characters on a black-colored background. The light emitting device in accordance with the present invention is used as the display portion 2703, thereby the mobile phone of the present invention completing.

When the brighter luminance of light emitted from the organic light emitting material becomes available in the future, the light emitting device in accordance with the present invention will be applicable to a front-type or rear-type projector in which light including output image information is enlarged by means of lenses or the like to be projected.

The aforementioned electronic apparatuses are more likely to be used for display information distributed through a telecommunication path such as Internet, a CATV (cable television system), and in particular likely to display moving picture information. The light emitting device is suitable for displaying moving pictures since the organic light emitting material can exhibit high response speed.

A portion of the light emitting device that is emitting light consumes power, so it is desirable to display information in such a manner that the light emitting portion therein becomes as small as possible. Accordingly, when the light emitting device is applied to a display portion which mainly displays character information, e.g., a display portion of a portable information terminal, and more particular, a portable telephone or a sound reproduction device, it is desirable to drive the light emitting device so that the character information is formed by a light emitting portion while a non-emission portion corresponds to the background.

As set forth above, the present invention can be applied variously to a wide range of electronic apparatuses in all fields. The electronic apparatuses in this embodiment can be obtained by utilizing a light emitting device having the structure in which the structures in Embodiment 1 through 10 are freely combined.

Embodiment 12

The embodiment illustrates a deterioration correction unit which is employed by a light emitting device having 176×RGB×220 pixels and which serves to correct a image signal representative of 6-bit gradation for each color. A specific arrangement of the deterioration correction unit is described.

Figure 22:
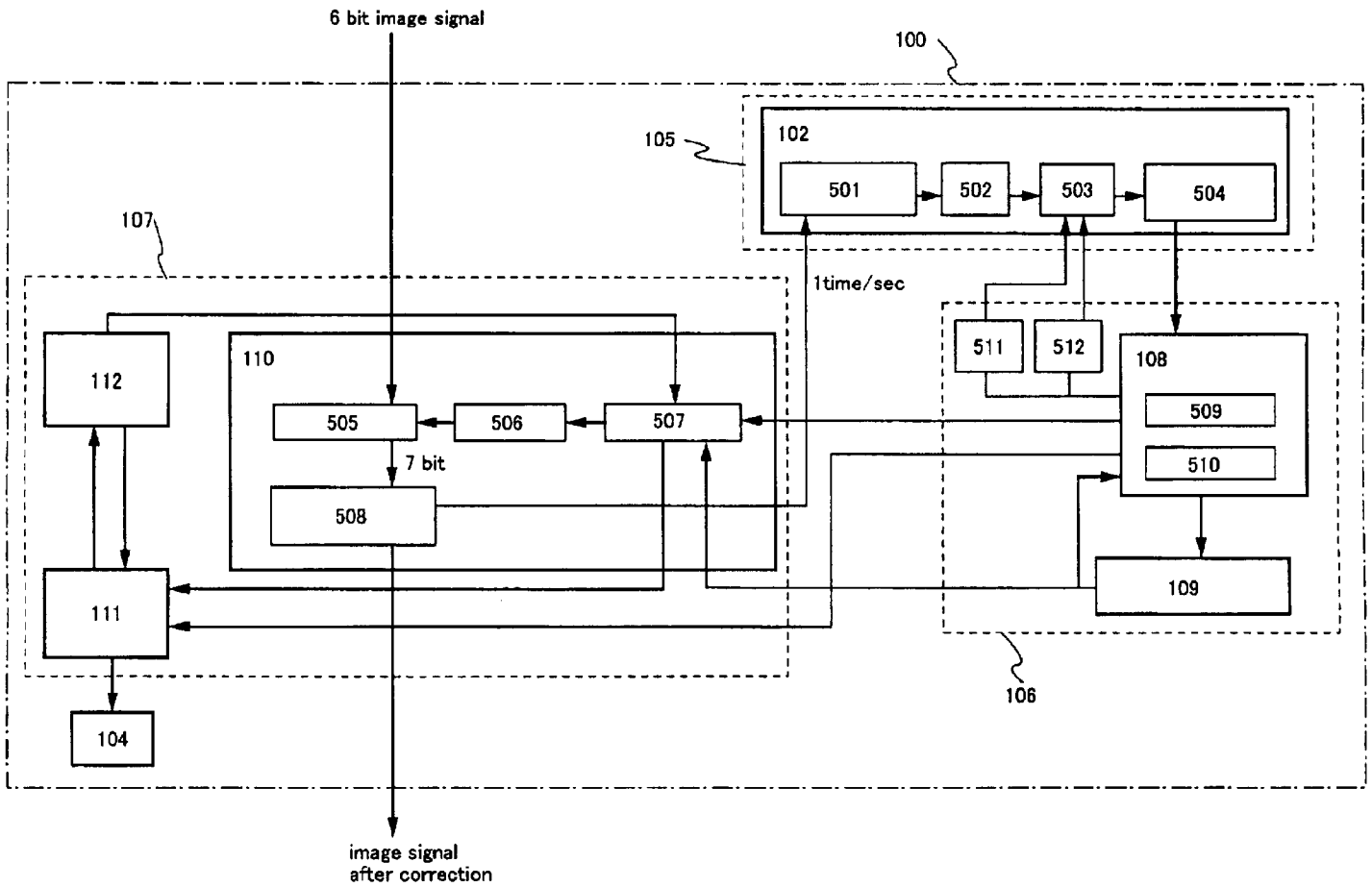
FIG. 22 is a block diagram showing a deterioration correction unit.

FIG. 22 is a block diagram showing the deterioration correction unit of this embodiment. In the figure, those elements already described are represented by the same reference numerals, respectively. As shown in FIG. 22, the counter 102 includes a sampling circuit 501, a register 502, an adder 503 and a line memory 504 (176×32 bits). The image signal correction circuit 110 includes an integration circuit 505, a register 506, an operation circuit 507 and an RGB register 508 (RGB×7 bits). The volatile memory 108 includes two SRAMs 509 and 510 (256×16 bits), the two SRAMs having a total capacity of the number of pixels×32 bits (approximately 4M bits). This embodiment employs a flash memory as the non-volatile memory 109. In addition to the volatile memory 108 and the non-volatile memory 109, two registers 511 and 512 are provided in the memory circuit portion 106.

The non-volatile memory 109 stores cumulative data on light emission periods or gradation levels as well as data on the degree of deterioration of each of the pixels. At the activation of the light emitting device, no light emission period or gradation level is accumulated so that the non-volatile memory 109 holds "0". Upon activation of the light emitting device, the data stored in the non-volatile memory 109 are transferred to the volatile memory 108.

When the light emission is started, the integration circuit 505 multiplies the 6-bit image signal by a correction coefficient stored in the register 506, thereby correcting the image signal. An initial correction coefficient is 1. In order to increase the correction accuracies of the integration circuit 505, the 6-bit image signal is converted to a 7-bit image signal. The image signal corrected by multiplying the correction coefficient is sent to the signal line drive circuit 101 or a circuit of the rear stage, such as a sub-frame period generating circuit (not shown) for processing the image signal to establish correspondence between the image signal and a sub-frame period.

On the other hand, the 7-bit image signal so corrected by multiplying the correction coefficient is sampled by the sampling circuit 501 in the counter 102 and then sent to the register 502. It is noted that the sampling circuit 501 is not necessary if all the image signals are sent to the register 502. However, the capacity of the volatile memory 108 can be reduced by making provision for the sampling. If, for example, each sampling of image signal is performed on a per-second basis, the area of the volatile memory 108 on the substrate can be reduced to 1/60.

Although each sampling is performed on a per-second basis according to the above description, the invention is not limited by this.

The sampled image signal is sent from the register 502 to the adder 503, to which the cumulative data on the light emission periods or gradation levels stored in the volatile memory 108 are inputted via the registers 511 and 512. The registers 511 and 512 are provided for adjusting the timing of data input from the volatile memory 108 to the adder 503. However, if the data can be called up quickly enough from the volatile memory 108, the registers 511 and 512 can be dispensed with.

The adder 503, in turn, adds a light emission period or gradation level, which is the information held by the sampled image signal, to the cumulative data on the light emission periods or gradation levels which are stored in the volatile memory 108. Then resultant data are stored in the line memory 504 of stage 176. In the embodiment hereof, the data processed by the line memory 504 and the volatile memory 108 are defined to consist of 32 bits per pixel. The memory of this capacity is capable of storing about 18000-hour's worth of data.

The cumulative data on the light emission periods or gradation levels stored in the line memory 504 are committed again to storage at the volatile memory 108 and read out again after the lapse of 1 second so that a sampled image signal is added thereto. In this manner, the adding operation is performed sequentially.

An arrangement is made such that when the power is turned OFF, the data in the volatile memory 108 is stored in the non-volatile memory 109 thereby avoiding a problem associated with the loss of memory in the volatile memory 108.

Figure 23:
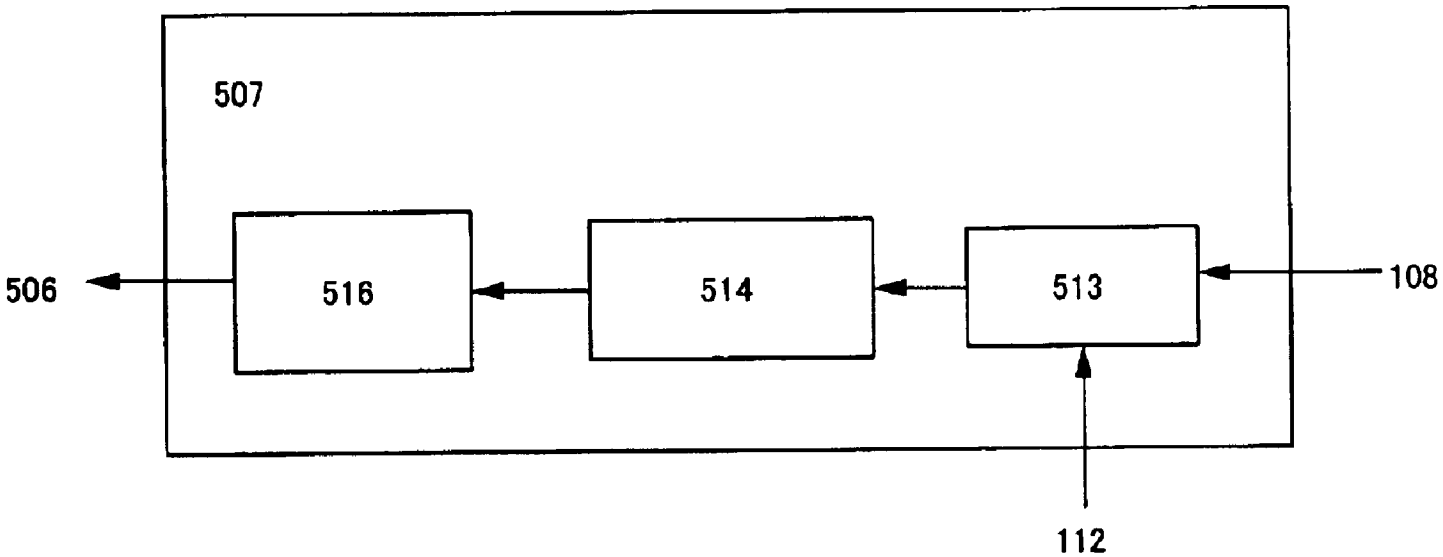
FIG. 23 is a block diagram showing an operating circuit.

FIG. 23 is a block diagram showing the operation circuit 507. The cumulative data on the light emission periods or gradation levels stored in the volatile memory 108 are inputted to a functional unit 513. The functional unit 513 calculates a correction coefficient using the cumulative data on the light emission periods or gradation levels stored in the volatile memory 108 and the data on the time-varying luminance characteristic stored in the correction data storage circuit 112. The resultant correction coefficient is temporarily stored in an 8-bit line memory 514 and then stored in an SRAM 516. The SRAM 516 is adapted to store 8-bit data representative of the correction coefficients for 256 gradation levels for each pixel. The correction coefficient is temporarily stored in the register 506 before inputted to the integration circuit 505, where the correction is performed by multiplying an image signal by the input correction coefficient.

Similarly to the case illustrated by the embodiment of the invention, the current correction circuit 111 compares the data on the time-varying luminance characteristic previously stored in the correction data storage circuit 112 with the cumulative data representing the light emission periods or gradation levels on each pixel and stored in the volatile memory 108, thereby grasping the degree of deterioration of each pixel. Then, the circuit detects a particular pixel suffering the greatest deterioration and corrects the value of the current supply from the current source 104 to the pixel portion 103 according to the degree of deterioration of the particular pixel. Specifically, the current value is increased such that the particular pixel may display a desired gradation level.

Since the value of the current supply to the pixel portion 103 is corrected based on the particular pixel, an excessive current is supplied to the light emitting elements of the other pixels less deteriorated than the particular pixel and hence, the other pixels cannot achieve the desired gradation level. Accordingly, the image signal correction circuit 110 corrects the image signal for determining the gradation level of each of the other pixels. In addition to the cumulative data on the light emission periods or gradation levels, the image signal is inputted to the image signal correction circuit 110. The image signal correction circuit 110 compares the data on the time-varying luminance characteristic previously stored in the correction data storage circuit 112 with the cumulative data on the light emission periods or gradation levels of each pixel thereby grasping the degree of deterioration of each pixel. Thus, the circuit detects a particular pixel most deteriorated and corrects the input image signal based on the degree of deterioration of the particular pixel. Specifically, the image signal is so corrected as to achieve a desired gradation level. The corrected image signal is inputted to the signal line drive circuit 101.

The embodiment of the invention can be practiced in combination with any one of the Embodiments 3 to 11 hereof.

The invention provides the light emitting device which is adapted to correct the deterioration of the light emitting elements associated with different light emission periods by way of the circuits and is capable of making a consistent screen display free from luminance variations.

What is claimed is:

1. A light emitting device comprising:

a plural light emitting elements;

a current source for supplying a current to the plural light emitting elements;

means for calculating an accumulation of light emission periods or gradation levels of each of the plural light emitting elements based on an image signal for controlling the light emission periods of the plural light emitting elements;

means for storing data on a time-varying luminance characteristic of a light emitting element;

means for determining an amount of luminance variation of the plural light emitting elements based on the calculated accumulation of the light emission periods or gradation levels of the plural light emitting elements and on the data on the time-varying luminance characteristic of the light emitting element, and for correcting the current supplied from the current source to the plural light emitting elements so that the luminance of one particular light emitting element among the plural light emitting elements returns to an initial value; and means for correcting the image signal so that a difference between an amount of luminance variation of the one particular light emitting element and that of the other light emitting elements are compensated, and for correcting the gradation level of the other light emitting elements.

2. A light emitting device according to claim 1, wherein the correction of the current supplied from the current source to the plural light emitting elements is suspended when a ratio of the amount of luminance variation of the one particular light emitting element versus the initial value reaches a given value.

3. An electronic apparatus comprising the light emitting device according to claim 1, wherein the electronic apparatus is selected from the group consisting of a display device, a digital still camera, a lap-top computer, a mobile computer, a portable image reproduction device, a goggle type display, a video camera, and a mobile phone.

4. A light emitting device comprising:

a plural light emitting elements;

a current source for supplying a current to the plural light emitting elements;

means for calculating an accumulation of light emission periods or gradation levels of each of the plural light emitting elements based on an image signal for controlling the light emission periods of the plural light emitting elements;

means for storing data on a time-varying luminance characteristic of a light emitting element;

means for determining an amount of luminance variation of the plural light emitting elements based on the calculated accumulation of the light emission periods or gradation levels of the plural light emitting elements and on the data on the time-varying luminance characteristic of the light emitting element, and for correcting the current supplied from the current source to the plural light emitting elements so that the luminance of one particular light emitting element among the plural light emitting elements returns to an initial value; and means for correcting the image signal so that a difference between an amount of luminance variation of the one particular light emitting element and that of the other light emitting elements are compensated, and for correcting the gradation level of the other light emitting elements, wherein an image signal for controlling the gradation level of the other light emitting elements is increased by m bits (m denotes an integer) than the one particular light emitting element by the correction of the image signal.

5. A light emitting device according to claim 4, wherein the correction of the current supplied from the current source to the plural light emitting elements is suspended when a ratio of the amount of luminance variation of the one particular light emitting element versus the initial value reaches a given value.

6. An electronic apparatus comprising the light emitting device according to claim 4, wherein the electronic apparatus is selected from the group consisting of a display device, a digital still camera, a lap-top computer, a mobile computer, a portable image reproduction device, a goggle type display, a video camera, and a mobile phone.

7. A light emitting device comprising:

a plural light emitting elements;

a current source for supplying a current to the plural light emitting elements;

means for sampling an image signal for controlling light emission periods of the plural light emitting elements over several times, for detecting a presence or absence of light emissions from each of the plural light emitting elements, and for counting the number of light emissions of each of the plural light emitting elements;

means for storing data on a time-varying luminance characteristic of a light emitting element;

means for determining an amount of luminance variation of each of the plural light emitting elements based on a ratio of the number of light emissions from each of the plural light emitting elements versus the total count of detections and on the data on the time-varying luminance characteristic of the light emitting element, and for correcting the current supplied from the current source to the plural light emitting elements so that the luminance of one particular light emitting element among the plural light emitting elements returns to an initial value; and means for correcting the image signal so that a difference between an amount of luminance variation of the one particular light emitting element and that of the other light emitting elements are compensated, and for correcting the gradation level of each of the other light emitting elements.

8. A light emitting device according to claim 7, wherein the correction of the current supplied from the current source to the plural light emitting elements is suspended when a ratio of the amount of luminance variation of the one particular light emitting element versus the initial value reaches a given value.

9. An electronic apparatus comprising the light emitting device according to claim 7, wherein the electronic apparatus is selected from the group consisting of a display device, a digital still camera, a lap-top computer, a mobile computer, a portable image reproduction device, a goggle type display, a video camera, and a mobile phone.

10. A light emitting device comprising:

a plural light emitting elements;

a current source for supplying a current to the plural light emitting elements;

means for sampling an image signal for controlling light emission periods of the plural light emitting elements over several times, for detecting a presence or absence of light emissions from each of the plural light emitting elements, and for counting the number of light emissions of each of the plural light emitting elements;

means for storing data on a time-varying luminance characteristic of a light emitting element;

means for determining an amount of luminance variation of each of the plural light emitting elements based on a ratio of the number of light emissions from each of the plural light emitting elements versus the total count of detections and on the data on the time-varying luminance characteristic of the light emitting element, and for correcting the current supplied from the current source to the plural light emitting elements so that the luminance of one particular light emitting element among the plural light emitting elements returns to an initial value; and means for correcting the image signal so that a difference between an amount of luminance variation of the one particular light emitting element and that of the other light emitting elements are compensated, and for correcting the gradation level of each of the other light emitting elements, wherein an image signal for controlling the gradation level of the another light emitting elements is increased by m bits (m denotes an integer) than the one light emitting element by the correction of the image signal.

11. A light emitting device according to claim 10, wherein the correction of the current supplied from the current source to the plural light emitting elements is suspended when a ratio of the amount of luminance variation of the one particular light emitting element versus the initial value reaches a given value.

12. An electronic apparatus comprising the light emitting device according to claim 10, wherein the electronic apparatus is selected from the group consisting of a display device, a digital still camera, a lap-top computer, a mobile computer, a portable image reproduction device, a goggle type display, a video camera, and a mobile phone.

13. A light emitting device comprising:

a plural first light emitting elements;

a current source for supplying a current to the plural first light emitting elements;

means for calculating a sum of light emission periods of each of the plural first light emitting elements based on image signals;

means for storing an amount of luminance variation of a second light emitting element based on a sum of light emission periods thereof;

means for determining an amount of luminance variation of each of the plural first light emitting elements from the sum of the light emission periods of each of the plural first light emitting elements and the stored amount of luminance variation of the second light emitting element based on the sum of the light emission periods thereof, for detecting one particular first light emitting element having the greatest sum of the light emission period from the plural first light emitting elements, and for correcting the current supply from the current source to the plural first light emitting elements based on the amount of luminance variation of the one particular first light emitting element so that the luminance of one particular first light emitting elements returns to an initial value; and means for correcting the image signal so that a difference between an amount of luminance variation of the one particular first light emitting element and that of the other first light emitting elements are compensated, and for correcting the gradation level of the other first light emitting elements.

14. A light emitting device according to claim 13, wherein the storage means comprises a static memory circuit.

15. A light emitting device according to claim 13, wherein the storage means comprises a dynamic memory circuit.

16. A light emitting device according to claim 13, wherein the storage means comprises a ferroelectric memory circuit.

17. A light emitting device according to claim 13, wherein the correction of the current supplied from the current source to the plural light emitting elements is suspended when a ratio of the amount of luminance variation of the one particular light emitting element versus the initial value reaches a given value.

18. An electronic apparatus comprising the light emitting device according to claim 13, wherein the electronic apparatus is selected from the group consisting of a display device, a digital still camera, a lap-top computer, a mobile computer, a portable image reproduction device, a goggle type display, a video camera, and a mobile phone.

19. a plural first light emitting elements;

a current source for supplying a current to the plural first light emitting elements;

means for calculating a sum of light emission periods of each of the plural first light emitting elements based on image signals;

means for storing an amount of luminance variation of a second light emitting element based on a sum of light emission periods thereof;

means for determining an amount of luminance variation of each of the plural first light emitting elements from the sum of the light emission periods of each of the plural first light emitting elements and the stored amount of luminance variation of the second light emitting element based on the sum of the light emission periods thereof, for detecting one particular first light emitting element having the greatest sum of the light emission period from the plural first light emitting elements, and for correcting the current supply from the current source to the plural first light emitting elements based on the amount of luminance variation of the one particular first light emitting element so that the luminance of one particular first light emitting elements returns to an initial value; and means for correcting the image signal so that a difference between an amount of luminance variation of the one particular first light emitting element and that of the other first light emitting elements are compensated, and for correcting the gradation level of the other first light emitting elements, wherein an image signal for controlling the gradation level of the another light emitting elements is increased by m bits (m denotes an integer) than the one light emitting element by the correction of the image signal.

20. A light emitting device according to claim 19, wherein the storage means comprises a static memory circuit.

21. A light emitting device according to claim 19, wherein the storage means comprises a dynamic memory circuit.

22. A light emitting device according to claim 19, wherein the storage means comprises a ferroelectric memory circuit.

23. A light emitting device according to claim 19, wherein the correction of the current supplied from the current source to the plural light emitting elements is suspended when a ratio of the amount of luminance variation of the one particular light emitting element versus the initial value reaches a given value.

24. An electronic apparatus comprising the light emitting device according to claim 19, wherein the electronic apparatus is selected from the group consisting of a display device, a digital still camera, a lap-top computer, a mobile computer, a portable image reproduction device, a goggle type display, a video camera, and a mobile phone.

25. A light emitting device comprising:

a plural light emitting elements;

a current source for supplying a current to the plural light emitting elements;

a first circuit for calculating an accumulation of light emission periods or gradation levels of each of the plural light emitting elements based on an image signal;

a second circuit for storing data on a time-varying luminance characteristic of a light emitting element;

a third circuit for correcting the current supplied from the current source to the plural light emitting elements based on an amount of luminance variation of the plural light emitting elements or gradation levels of the plural light emitting elements and on the data on the time-varying luminance characteristic of the light emitting element; and a fourth circuit for correcting the image signal in order to correct the gradation level of at least a part of the plural light emitting elements.

26. An electronic apparatus comprising the light emitting device according to claim 25, wherein the electronic apparatus is selected from the group consisting of a display device, a digital still camera, a lap-top computer, a mobile computer, a portable image reproduction device, a goggle type display, a video camera, and a mobile phone.

27. A light emitting device comprising:

a plural light emitting elements;

a current source for supplying a current to the plural light emitting elements;

a first circuit for detecting a presence or absence of light emissions from each of the plural light emitting elements by sampling an image signal over several times;

a second circuit for counting the number of light emissions of the each of the plural light emitting elements;

a third circuit for storing data on a time-varying luminance characteristic of a light emitting element;

a fourth circuit for correcting the current supplied from the current source to the plural light emitting elements based on a ratio of the number of light emissions versus the total defection and on the data on the time-varying luminance characteristic of the light emitting element; and a fifth circuit for correcting the image signal in order to correct the gradation level of at least a part of the plural light emitting elements.

28. An electronic apparatus comprising the light emitting device according to claim 27, wherein the electronic apparatus is selected from the group consisting of a display device, a digital still camera, a lap-top computer, a mobile computer, a portable image reproduction device, a goggle type display, a video camera, and a mobile phone.

29. A light emitting device comprising:

a plural first light emitting elements;

a current source for supplying a current to the plural first light emitting elements;

a first circuit for calculating a sum of light emission periods of each of the plural first light emitting elements based on image signals;

a second circuit for storing an amount of luminance variation of a second light emitting element based on a sum of light emission periods thereof;

a third circuit for correcting the current supplied from the current source to the plural first light emitting elements from the sum of the light emission periods of each of the plural first light emitting elements and the amount of luminance variation of a second light emitting element based on a sum of light emission periods thereof;

a fourth circuit for correcting the image signal in order to correcting the gradation level of at least a part of the plural first light emitting elements.

30. A light emitting device according to claim 29, wherein the storage means comprises a static memory circuit.

31. A light emitting device according to claim 29, wherein the storage means comprises a dynamic memory circuit.

32. A light emitting device according to claim 29, wherein the storage means comprises a ferroelectric memory circuit.

33. An electronic apparatus comprising the light emitting device according to claim 29, wherein the electronic apparatus is selected from the group consisting of a display device, a digital still camera, a lap-top computer, a mobile computer, a portable image reproduction device, a goggle type display, a video camera, and a mobile phone.

34. A light emitting device comprising:

a plural light emitting elements;

a current source for supplying a current to the plural light emitting elements;

a counter;

a circuit for storing the data on a time-varying luminance characteristic of a light emitting element;

a first correction circuit for correcting the current supplied from the current source to the plural light emitting elements, the first correction circuit connected to the current source; and a second correction circuit for correcting for correcting the image, the second correction circuit connected to the counter, wherein the circuit for storing the data is connected to the first correction circuit and the second correction circuit, respectively.

35. An electronic apparatus comprising the light emitting device according to claim 34, wherein the electronic apparatus is selected from the group consisting of a display device, a digital still camera, a lap-top computer, a mobile computer, a portable image reproduction device, a goggle type display, a video camera, and a mobile phone.

* * * * *